US007914324B2

(12) United States Patent
Pepe et al.

(10) Patent No.: US 7,914,324 B2
(45) Date of Patent: Mar. 29, 2011

(54) CASSETTE FOR USE WITHIN A CONNECTIVITY MANAGEMENT SYSTEM

(75) Inventors: Paul John Pepe, Clemmons, NC (US); Sheldon Easton Muir, Whitsett, NC (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/395,049

(22) Filed: Feb. 27, 2009

(65) Prior Publication Data

US 2010/0221932 A1 Sep. 2, 2010

(51) Int. Cl.
*H01R 13/66* (2006.01)

(52) U.S. Cl. ..... 439/540.1

(58) Field of Classification Search ..... 439/540.1, 439/488–489, 490, 395, 676
See application file for complete search history.

(56) References Cited

U.S. PATENT DOCUMENTS

| | | | | |
|---|---|---|---|---|
| 5,178,554 | A * | 1/1993 | Siemon et al. | 439/188 |
| 5,562,493 | A | 10/1996 | Ferrill et al. | |
| 6,120,318 | A | 9/2000 | Reed et al. | |
| 6,132,260 | A | 10/2000 | Wu | |
| 6,222,908 | B1 | 4/2001 | Bartolutti et al. | |
| 6,302,742 | B1 | 10/2001 | Berst et al. | |
| 6,364,707 | B1 | 4/2002 | Wang | |
| 6,364,713 | B1 | 4/2002 | Kuo | |
| 6,540,564 | B1 | 4/2003 | Ko | |
| 6,608,764 | B2 | 8/2003 | Clark et al. | |
| 6,612,867 | B1 | 9/2003 | Wu | |
| 6,626,697 | B1 * | 9/2003 | Martin et al. | 439/488 |
| 6,655,988 | B1 | 12/2003 | Simmons et al. | |
| 6,780,035 | B2 | 8/2004 | Bohbot | |
| 6,786,772 | B1 | 9/2004 | Liu | |
| 6,802,735 | B2 | 10/2004 | Pepe et al. | |
| 6,976,867 | B2 | 12/2005 | Navarro et al. | |
| 6,988,914 | B2 | 1/2006 | Pepe | |
| 7,033,210 | B1 | 4/2006 | Laurer et al. | |
| 7,077,707 | B2 | 7/2006 | Hyland et al. | |
| 7,140,924 | B2 | 11/2006 | Redfield et al. | |
| 7,300,307 | B2 | 11/2007 | Murr | |
| 7,357,675 | B2 | 4/2008 | Barringer et al. | |
| 7,367,850 | B1 | 5/2008 | Chang | |
| 7,384,310 | B2 | 6/2008 | Hu et al. | |
| 7,530,854 | B2 | 5/2009 | Aekins et al. | |
| 2003/0095395 | A1 | 5/2003 | Clark et al. | |

(Continued)

FOREIGN PATENT DOCUMENTS

| | | |
|---|---|---|
| EP | 1458062 | 9/2004 |

(Continued)

OTHER PUBLICATIONS

International Search Report, International Application No. PCT/US2010/000564, International Filing Date Feb. 24, 2010.

*Primary Examiner* — Jean F Duverne

(57) ABSTRACT

A cassette includes a housing having a plurality of plug cavities configure to receive plugs therein, and a contact subassembly received in the housing. The contact subassembly has a circuit board and a plurality of contacts coupled to the circuit board, with the contacts being arranged in contact sets that are received in different plug cavities to mate with different ones of the plugs. The cassette also includes a connectivity sensor coupled to the housing. The connectivity sensor is electrically connected to the circuit board of the contact subassembly, and the connectivity sensor has a plurality of sensor pads configured to interface with sensor probes of the plugs when the plugs are loaded into the plug cavities.

20 Claims, 14 Drawing Sheets

U.S. PATENT DOCUMENTS

| | | | |
|---|---|---|---|
| 2004/0209515 | A1 | 10/2004 | Caveney et al. |
| 2004/0229501 | A1 | 11/2004 | Caveney et al. |
| 2004/0246693 | A1 | 12/2004 | Lloyd et al. |
| 2005/0136747 | A1 | 6/2005 | Caveney et al. |
| 2005/0164548 | A1 | 7/2005 | Spears et al. |
| 2005/0185912 | A1 | 8/2005 | Levesque |
| 2005/0282432 | A1 | 12/2005 | Murr et al. |
| 2005/0282441 | A1 | 12/2005 | Murr et al. |
| 2006/0246784 | A1 | 11/2006 | Aekins et al. |
| 2007/0032129 | A1 | 2/2007 | Kim et al. |
| 2007/0066141 | A1 | 3/2007 | Shu et al. |
| 2008/0090461 | A1 | 4/2008 | Pepe et al. |

FOREIGN PATENT DOCUMENTS

| | | | |
|---|---|---|---|
| GB | 2339090 | | 1/2000 |
| WO | WO 2005/053111 | A1 | 6/2005 |
| WO | WO 2006/063023 | A1 | 6/2006 |

* cited by examiner

CASSETTE FOR USE WITHIN A CONNECTIVITY MANAGEMENT SYSTEM

CROSS REFERENCE TO RELATED APPLICATIONS

This application is related to copending U.S. patent application Ser. No.12/394,816 , filed Feb. 27, 2009, the subject matter of which is herein incorporated by reference in its entirety. U.S. patent application Ser. No. 12/394,816 relates to U.S. patent application Ser. No. 12/394,912, filed Feb. 27, 2009, relates to U.S. patent application Ser. No. 12/394,987, filed Feb. 27, 2009, and relates to U.S. patent application Ser. No. 12/395,144, filed Feb. 27, 2009.

BACKGROUND OF THE INVENTION

The subject matter herein relates generally to connector assemblies adaptable for use with connectivity management systems, and more particularly, to sensor arrangements and configurations for connector assemblies adaptable for use with a connectivity management system.

Known connector assemblies exist having multiple receptacle connectors in a common housing, which provide a compact arrangement of such receptacle connectors. Such a connector assembly is useful to provide multiple connection ports. Accordingly, such a connector assembly is referred to as a multiple port connector assembly. The receptacle connectors may be in the form of RJ-45 type modular jacks that establish mating connections with corresponding RJ-45 modular plugs. The receptacle, connectors, that is; modular jacks, each have electrical terminals arranged in a terminal array, and have plug receiving cavities.

In order to better operate large electrical networks, connectivity management systems have been developed to monitor connections between components within the network. The connector assemblies or other network components include a sensor arranged along a mating face of the connector assembly. The sensor is positioned to interface with a sensor probe of the plug when the plug is mated with the receptacle jack. Connectivity data is transmitted by the probe to the sensor, and the sensor transmits the connectivity data to an analyzer. The analyzer is able to determine which modular plug is connected to which modular jack and/or where each patch cord or cable is routed within the network system.

Known connectivity management systems are not without disadvantages. For instance, the sensors are typically, interconnected with the analyzer or other components of the connectivity management system by a wire harness. Wire harnesses are difficult and time consuming to assemble, and are not well suited for automation when manufacturing the connector assemblies.

BRIEF DESCRIPTION OF THE INVENTION

In one embodiment, a cassette is provided that includes a housing having a plurality of plug cavities configure to receive plugs therein, and a contact subassembly received in the housing. The contact subassembly has a circuit board and a plurality of contacts coupled to the circuit board, with the contacts being arranged in contact sets that are received in corresponding plug cavities to mate with different corresponding plugs. The cassette also includes a connectivity sensor coupled to the housing. The connectivity sensor is electrically connected to the circuit board of the contact subassembly, and the connectivity sensor has a plurality of sensor pads configured to interface with sensor probes of the plugs when the plugs are loaded into the plug cavities.

Optionally, the connectivity sensor may have a connectivity connector electrically coupled to at least some of the sensor pads, where the connectivity connector is electrically coupled to the circuit board of the contact subassembly. The connectivity sensor may have a circuit board with the sensor pads arranged on a first side of the circuit board and a connectivity connector coupled to a second side of the circuit board and being electrically connected to at least some of the sensor pads. Optionally, the contact subassembly may include a connectivity connector where the connectivity sensor is electrically connected to the connectivity connector of the contact subassembly. The circuit board of the connectivity sensor may be arranged generally parallel to the circuit board of the contact subassembly.

In another embodiment, a cassette is provided that includes a shell defining, a plurality of plug cavities for receiving plugs therein and a contact subassembly received within the shell. The contact subassembly has a circuit board, a plurality of contacts extending from a first side of the circuit board and an electrical connector extending from an opposite side of the circuit board. The contacts are configured to mate with corresponding plugs, and the electrical connector is electrically connected to corresponding contacts. A connectivity sensor is coupled to the shell and is electrically connected to the circuit board of the contact subassembly. The connectivity sensor has a plurality of sensor pads configured to interface with sensor probes of the plugs when the plugs are loaded into the plug cavities. An interface connector is received within the shell and mated with the electrical connector. The interface connector has a rear connectivity connector accessible at the rear of the shell that is configured to mate with a connectivity cable. The rear connectivity connector is electrically connected to the connectivity sensor via the electrical connector.

In further embodiment, a cassette is provided including a connectivity sensor having a circuit board and a plurality of sensor pads electrically connected to the circuit board. The sensor pads are configured to interface with sensor probes of plugs mated with the cassette. The cassette also includes an interface connector having a circuit board and a rear connectivity connector mounted to the circuit board. The rear connectivity connector is arranged generally opposite to the connectivity sensor and is configured to mate with a connectivity cabled. A contact subassembly is arranged between the connectivity sensor and the interface connector. The contact subassembly has a circuit board with the connectivity sensor being coupled to a first side of the circuit board and the interface connector being coupled to a second side of the circuit board that is-opposite to the first side. The rear connectivity connector is electrically connected to the connectivity sensor via the circuit board of the contact subassembly.

DETAILED DESCRIPTION OF THE INVENTION

Figure 1:
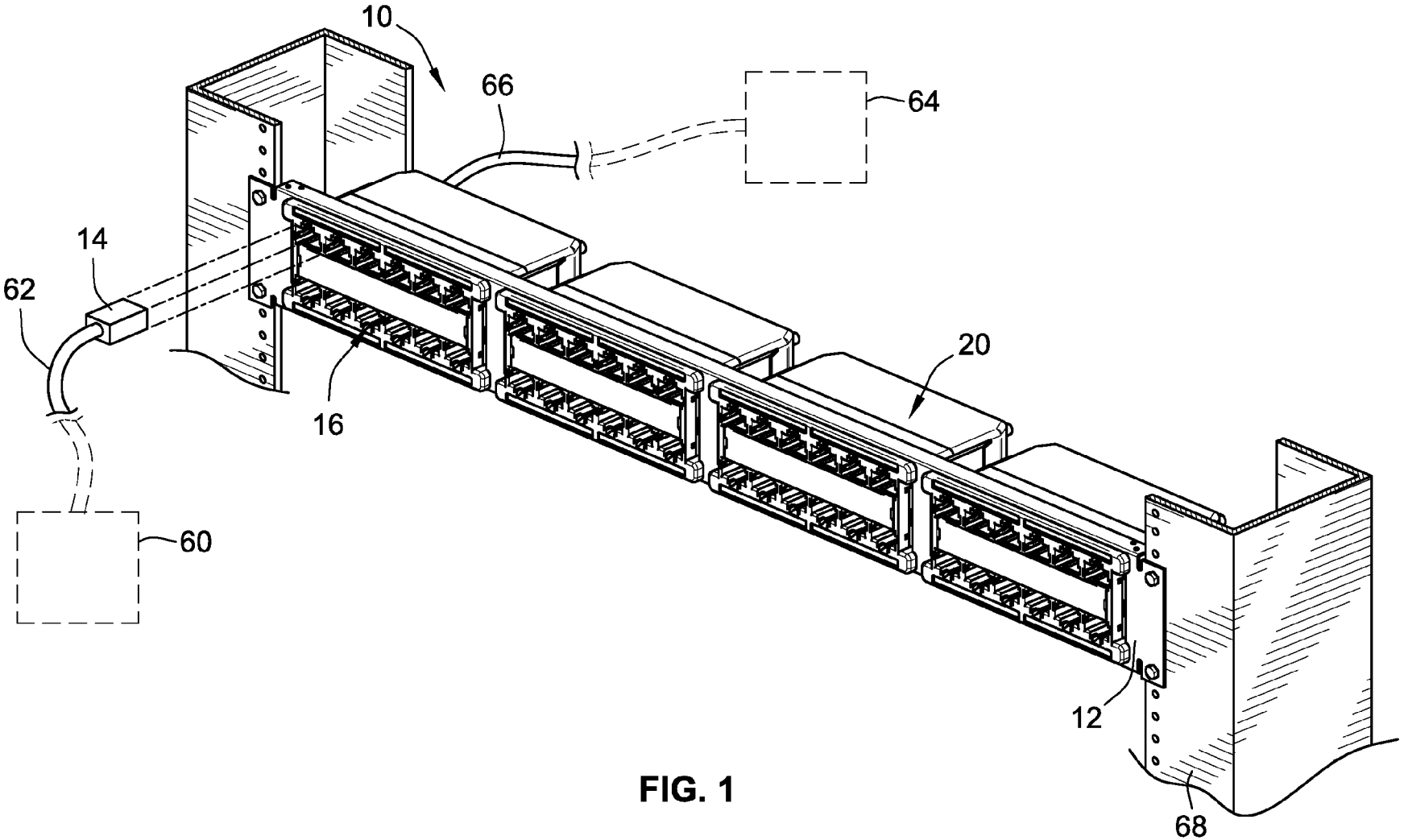
FIG. 1 is a front perspective view of a portion of a cable interconnect system incorporating a plurality of cassettes mounted to the panel with a modular plug connected thereto.

FIG. 1 is a front perspective view of a portion of a cable interconnect system 10 illustrating a panel 12 and a plurality of cassettes 20 mounted to the panel 12 and a modular plug 14 connected thereto. The cassette 20 comprises an array of receptacles 16 for accepting or receiving the modular plug 14.

The cable interconnect system 10 is utilized to interconnect various equipment, components and/or devices to one another. FIG. 1 schematically illustrates a first device 60 connected to the cassette 20 via a cable 62. The modular plug 14 is attached to the end of the cable 62. FIG. 1 also illustrates a second device 64 connected to the cassette 20 via a cable 66. The cassette 20 interconnects the first and second devices 60, 64. In an exemplary embodiment, the first device 60 may be a computer located remote from the cassette 20. The second device 64 may be a network switch. The second device 64 may be located in the vicinity of the cassette 20, such as in the same equipment room, or alternatively, may be located remote from the cassette 20. The cable interconnect system 10 may include a support structure 68, a portion of which is illustrated in FIG. 1, for supporting the panel 12 and the cassettes 20. For example, the support structure 68 may be an equipment rack of a network system. The panel 12 may be a patch panel that is mounted to: the equipment rack. In alternative embodiments, rather than a patch panel, the panel 12 may be another type of network component used with a network system that supports cassettes 20 and/or other connector assemblies, such as interface modules, stacked jacks, or other individual modular jacks. For example, the panel 12 may be a wall or other structural element of a component. It is noted that the cable interconnect system 10 illustrated in FIG. 1 is merely illustrative of an exemplary system/component for interconnecting communication cables using modular jacks and modular plugs or other types of connectors. Optionally, the second device 64 may be mounted to the support structured.

Figure 2:
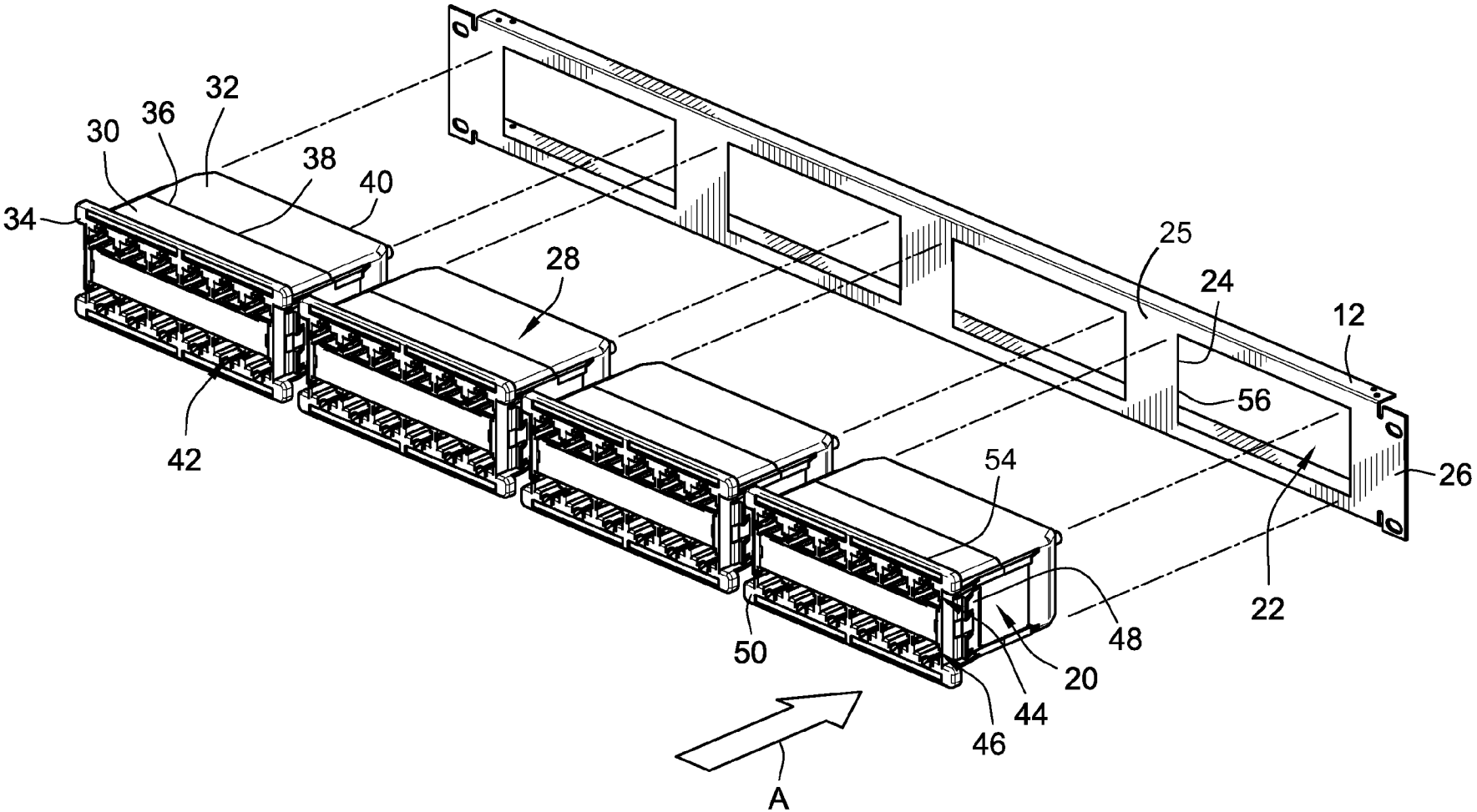
FIG. 2 is an exploded view of the panel and the cassettes illustrated in FIG. 1.

FIG. 2 is an exploded view of the panel 12 and the cassettes 20. The cassettes 20 are mounted within openings 22 of the panel 12. The openings 20 are defined by a perimeter wall 24. In an exemplary embodiment, the panel 12 includes a plurality of openings 22 for receiving a plurality of cassettes 20. The panel 12 includes a planar front surface 25, and the cassettes 20 are mounted against the front surface 25. The panel 12 includes mounting tabs 26 on the sides thereof for mounting to the support structure 68 (shown in FIG. 1). For example, the mounting tabs 26 may be provided at the sides of the panel 12 for mounting to a standard equipment rack or other cabinet system. Optionally, the panel 12 and mounting tabs 26 fit into 1 U height requirements.

The cassette 20 includes a shell 28 defining an outer perimeter of the cassette 20. In an exemplary embodiment, the shell 28 is a two piece design having a housing 30 and a cover 32 that may be coupled to the housing 30. The housing 30 and the cover 32 may have similar dimensions (e.g. height and width) to nest with one another to define a smooth outer surface. The housing 30 and the cover 32 may also have similar lengths, such that the housing 30 and the cover 32 mate approximately in the middle of the shell 28. Alternatively, the housing 30 may define substantially all of the shell 28 and the cover 32 may be substantially flat and be coupled to an end of the housing 30. Other alternative embodiments may not include the cover 32.

The housing 30 includes a front 34 and a rear 36. The cover 32 includes a front 38 and a rear 40. The front 34 of the housing 30 defines a front of the cassette 20 and the rear 40 of the cover 32 defines a rear of the cassette 20. In an exemplary embodiment, the cover 32 is coupled to the housing 30 such that the rear 36 of the housing 30 abuts against the front 38 of the cover 32.

The housing 30 includes a plurality of plug cavities 42 open at the front 34 of the housing 30 for receiving the modular plugs 14 (shown in FIG. 1). The plug cavities 42 define a portion of the receptacles 16. In an exemplary embodiment, the plug cavities 42 are arranged in a stacked configuration in a first row 44 and a second row 46 of plug cavities 42. A plurality of plug cavities 42 are arranged in each of the first and second rows 44, 46. In the illustrated embodiment, six plug cavities 42 are arranged in each of the first and second rows 44, 46, thus providing a total of twelve plug cavities 42 in each cassette 20. Four cassettes 20 are provided that are mounted to the panel 12, thus providing a total of forty-eight plug cavities 42. Such an arrangement provides forty-eight plug cavities 42 that receive forty-eight modular plugs 14 within the panel 12 that fits within 1 U height requirement. It is realized that the cassettes 20 may have more or less than twelve plug cavities 42 arranged in more or less than two rows of plug cavities 42. It is also realized that more or less than four cassettes 20 may be provided for mounting to the panel 12.

The cassette 20 includes latch members 48 on one or more sides of the cassette 20 for securing the cassette 20 to the panel 12. The latch members 48 may be held close to the sides of the cassette 20 to maintain a smaller form factor. Alternative mounting means may be utilized in alternative embodiments. The latch members 48 may be separately provided from the housing 30 and/or the cover 32. Alternatively, the latch members 48 may be integrally formed with the housing 30 and/or the cover 32.

During assembly, the cassettes 20 are loaded into the openings 22 of the panel 12 from the front of the panel 12, such as in the loading direction illustrated in FIG. 2 by an arrow A. The outer perimeter of the cassette 20 may be substantially similar to the size and shape of the perimeter walls 24 defining the openings 22 such that the cassette 20 fits snugly within the openings 22. The latch members 48 are used to secure the cassettes 20 to the panel 12. In an exemplary embodiment, the cassettes 20 include a front flange 50 at the front 34 of the housing 30. The front flanges 50 have a rear engagement surface 52 that engages the front surface 25 of the panel 12 and the cassette 20 is loaded into the openings 22. The latch members 48 include a panel engagement surface 54 that is forward facing such that, when the cassette 20 is loaded into the opening 22, the panel engagement surface 54 engages a rear 56 of the panel 12. The panel 12 is captured between the rear engagement surface 52 of the front flanges 50 and the latch engagement surfaces 52 of the latch members 48.

Figure 3:
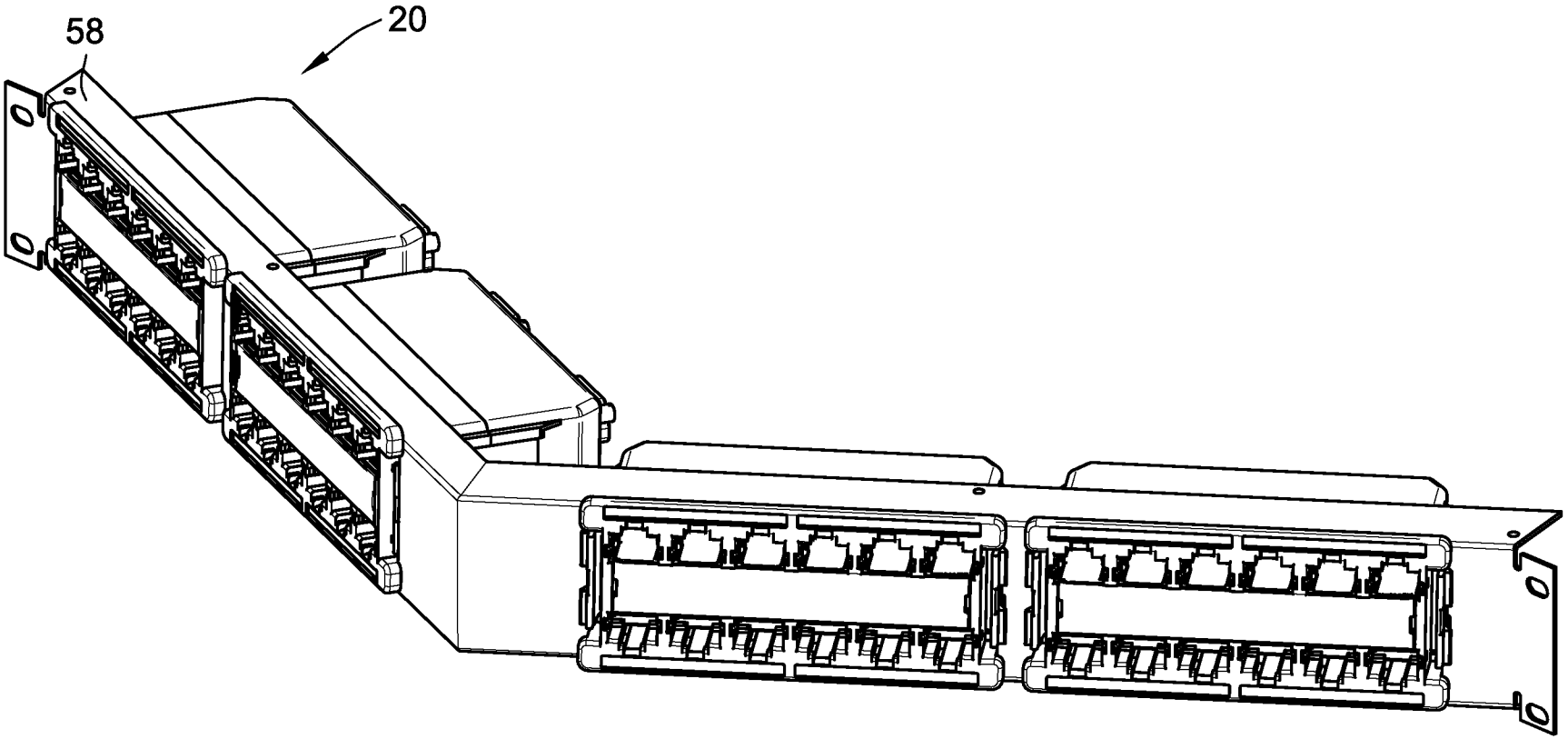
FIG. 3 is a front perspective view of an alternative panel for the cable interconnect system with cassettes mounted thereto.

FIG. 3 is a front perspective view of an alternative panel 58 for the cable interconnect system 10 with cassettes 20: mounted thereto. The panel 58 has a V-configuration such that the cassettes 20 are angled in different directions. Other panel configurations are possible in alternative embodiments. The cassettes 20 may be mounted to the panel 58 in a similar manner as the cassettes 20 are mounted to the panel 12 (shown in FIG. 1). The panel 58 may fit within 1 U height requirements.

Figure 4:
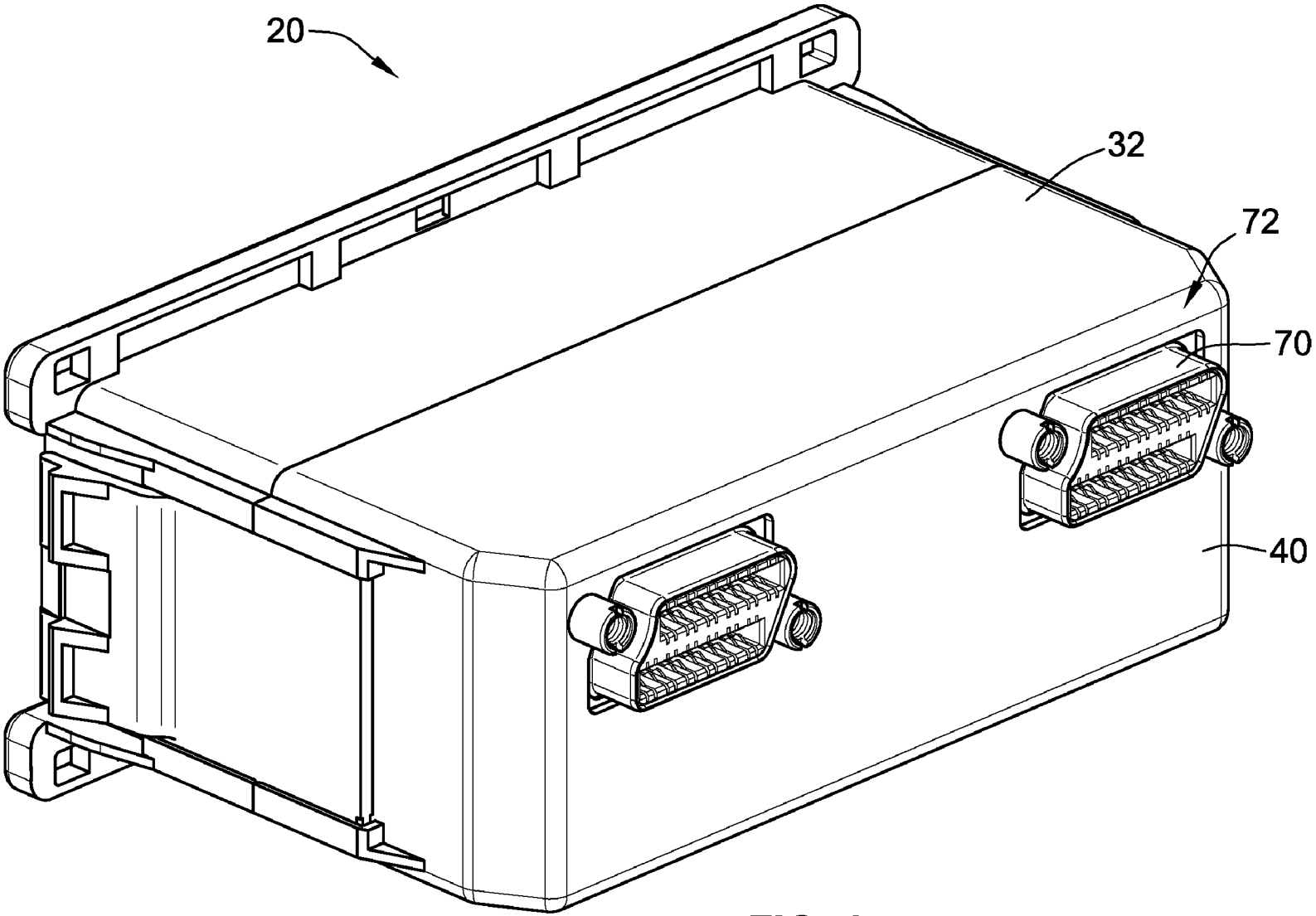
FIG. 4 is a rear perspective view of a cassette shown in FIG. 1.

FIG. 4 is a rear perspective view of one of the cassettes 20 illustrating a plurality of rear mating connectors 70. The rear mating connectors 70 are configured to mate with cable assemblies having a mating cable connector where the cable assemblies are routed to another device or component of the cable interconnect system 10 (shown in FIG. 1). For example, the cable connectors may be provided at ends of cables that are routed behind the panel 12 to a network switch or other network component. Optionally, a portion of the rear mating connectors 70 may extend through an opening 72 in the rear 40 of the cover 32. In the illustrated embodiment, the rear mating connectors 70 are represented by board mounted MRJ-21 connectors, however, it is realized that other types of connectors may be used rather than MRJ-21 type of connectors. For example, in alternative embodiments, the rear mating connectors 70 may be another type of copper-based modular connectors, fiber optic connectors or other types of connectors, such as eSATA connectors, HDMI connectors, USB connectors, FireWire connectors, and the like.

As will be described in further detail below, the rear mating connectors 70 are high density connectors, that is, each rear mating connector 70 is electrically connected to more than one of the receptacles 16 (shown in FIG. 1) to allow communication between multiple modular plugs 14 (shown in FIG. 1) and the cable connector that mates with the rear mating connector 70. The rear mating connectors 70 are electrically connected to more than one receptacles 16 to reduce the number of cable assemblies that interface with the rear of the cassette 20. It is realized that more or less than two rear mating connectors 70 may be provided in alternative embodiments.

Figure 5:
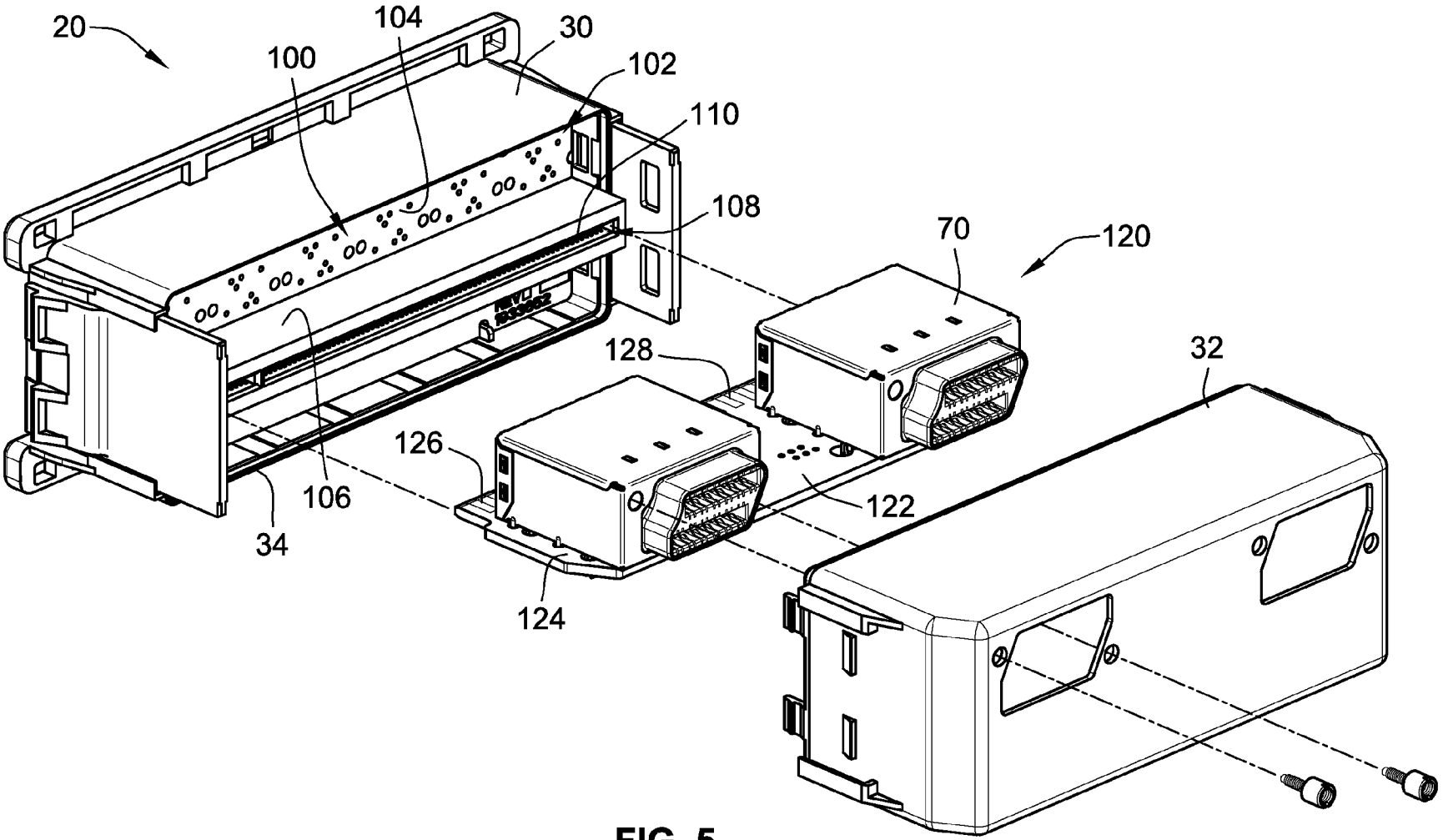
FIG. 5 is a rear exploded view of the cassette shown in FIG. 4.

FIG. 5 is a rear exploded view of the cassette 20 illustrating the cover 32 removed from the housing 30. The cassette 20 includes a contact subassembly 100 loaded into the housing 30. In an exemplary embodiment, the housing 30 includes a rear chamber 102 at the rear 36 thereof. The contact subassembly 100 is at least partially received in the rear chamber 102. The contact subassembly 100 includes a circuit board 104 and one or more electrical connectors 106 mounted to the circuit board 104. In an exemplary embodiment, the electrical connector 106 is a card edge connector. The electrical connector 106 includes at least one opening 108 and one or more contacts 110 within the opening 108. In the illustrated embodiment, the opening 108 is an elongated slot and a plurality of contacts 110 are arranged within the slot. The contacts 110 may be provided on one or both sides of the slot. The contacts 110 may be electrically connected to the circuit board 104.

The cassette 20 includes an interface connector assembly 120 that includes the rear mating connectors 70. The interface connector assembly 120 is configured to be mated with the electrical connector 106. In an exemplary embodiment, the interface connector assembly 120 includes a circuit board 122. The rear mating connectors 70 are mounted to a side surface 124 of the circuit board 122. In an exemplary embodiment, the circuit board 122 includes a plurality of edge contacts 126 along an edge 128 of the circuit board 122. The edge contacts 126 may be mated with the contacts 110 of the contact subassembly 100 by plugging the edge 128 of the circuit board 122 into the opening 108 of the electrical connector 106. The edge contacts 126 are electrically connected to the rear mating connectors 70 via the circuit board 122. For example, traces may be provided on or in the circuit board 122 that interconnect the edge contacts 126 with the rear mating connectors 70. The edge contacts 126 may be provided on one or more sides of the circuit board 122. The edge contacts 126 maybe contact pads formed on the circuit board 122. Alternatively, the edge contacts 126 may extend from at least one of the surfaces and/or the edge 128 of the circuit board 122. In alternative embodiment, rather than using edge contacts 126, the interface connector assembly 120 may include an electrical connector at, or proximate to, the edge 128 for mating with the electrical connector 106 of the contact subassembly 100.

Figure 6:
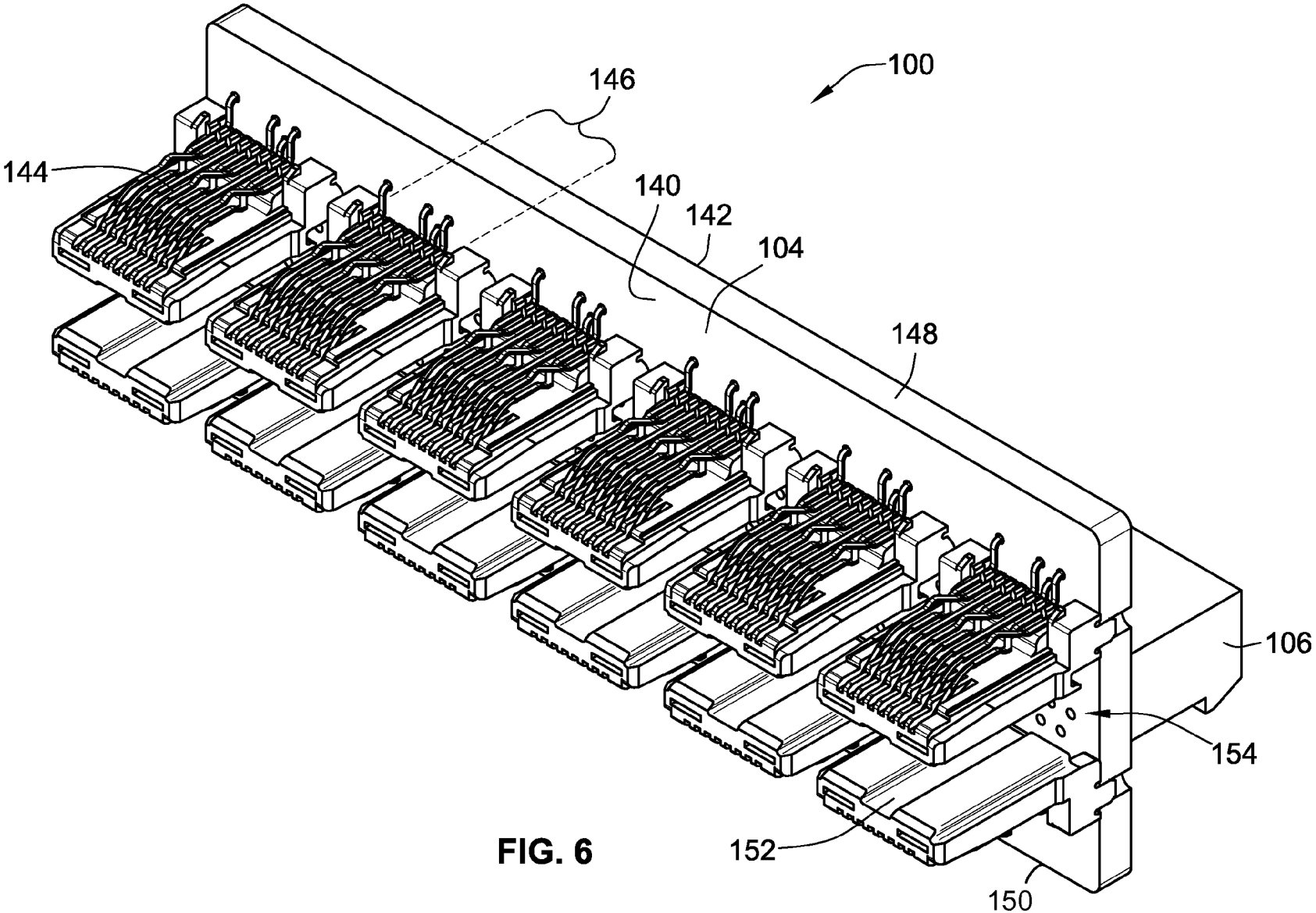
FIG. 6 illustrates a contact subassembly of the cassette shown in FIG. 4.

FIG. 6 illustrates the contact subassembly 100 of the cassette 20 (shown in FIG. 4). The circuit board 104 of the contact subassembly 100 includes a front side 140 and a rear side 142. The electrical connector 106 is mounted to the rear side 142. A plurality of contacts 144 extend from the front side 140 of the circuit board 104. The contacts 144 are electrically connected to the circuit board 104 and are electrically connected to the electrical connector 106 via the circuit board 104.

The contacts 144 are arranged in contact sets 146 with each contact set 146 defining a portion of a different receptacle 16 (shown in FIG. 1). For example, in the illustrated embodiment, eight contacts 144 are configured as a contact array defining each of the contact sets 146. The contacts 144 may constitute a contact array that is configured to mate with plug contacts of an RJ-45 modular plug. The contacts 144 may have a different configuration for mating with a different type of plug in alternative embodiments. More or less than eight contacts 144 may be provided in alternative embodiments. In the illustrated embodiment, six contact sets 146 are arranged in each of two rows in a stacked configuration, thus providing a total of twelve contact sets 146 for the contact subassembly 100. Optionally, the contact sets 146 may be substantially aligned with one another within each of the rows and may be aligned above or below another contact set 146. For example, an upper contact set 146 may be positioned relatively closer to a top 148 of the circuit board 104 as compared to a lower contact set 146 which may be positioned relatively closer to a bottom 150 of the circuit board 104.

In an exemplary embodiment, the contact subassembly 100 includes a plurality of contact supports 152 extending from the front side 140 of the circuit board 104. The contact supports 152 are positioned in close proximity to respective contact sets 146. Optionally, each contact support 152 supports the contacts 144 of a different contact set 146. In the illustrated embodiment, two rows of contact, supports 152 are provided. A gap 154 separates the contact supports 152. Optionally, the gap 154 may be substantially centered between the top 148 and the bottom 150 of the circuit board 104.

During assembly, the contact subassembly 100 is loaded into the housing 30 (shown in FIG. 2) such that the contact sets 146 and the contact supports 152 are loaded into corresponding plug cavities 42 (shown in FIG. 2). In an exemplary embodiment, a portion of the housing 30 extends between adjacent contact supports 152 within a row, and a portion of the housing 30 extends into the gap 154 between the contact supports 152.

Figure 7:
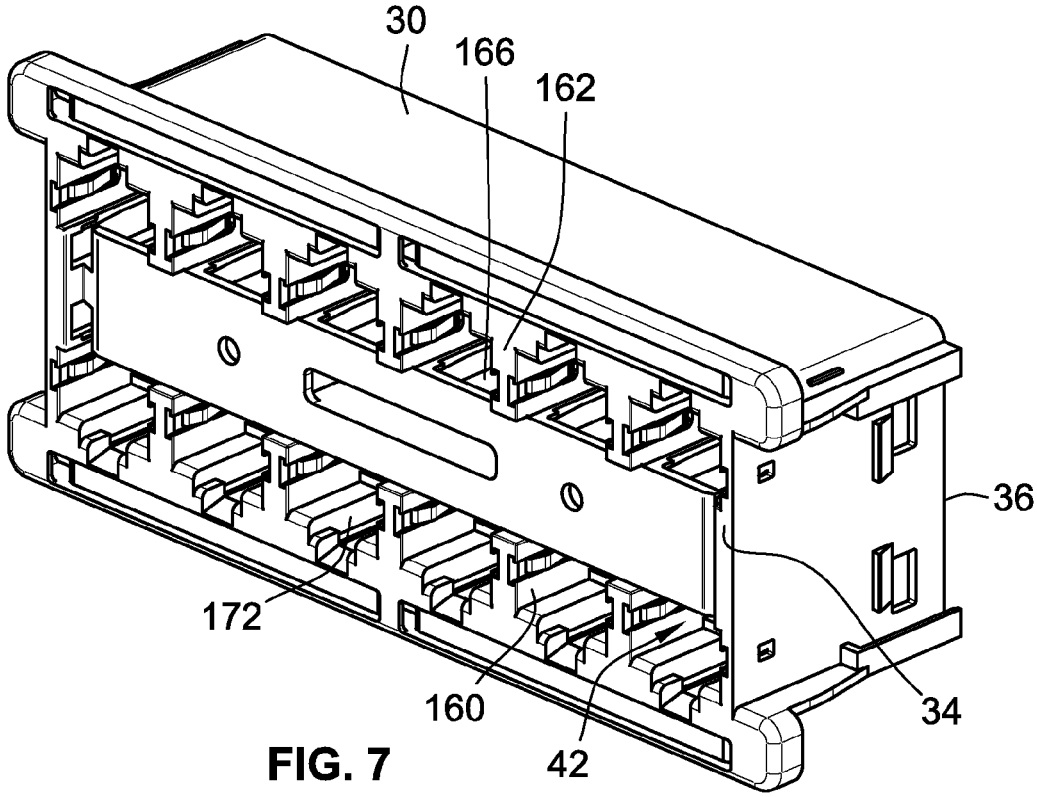
FIG. 7 is a front perspective view of a housing of the cassette shown in FIG. 4.
Figure 8:
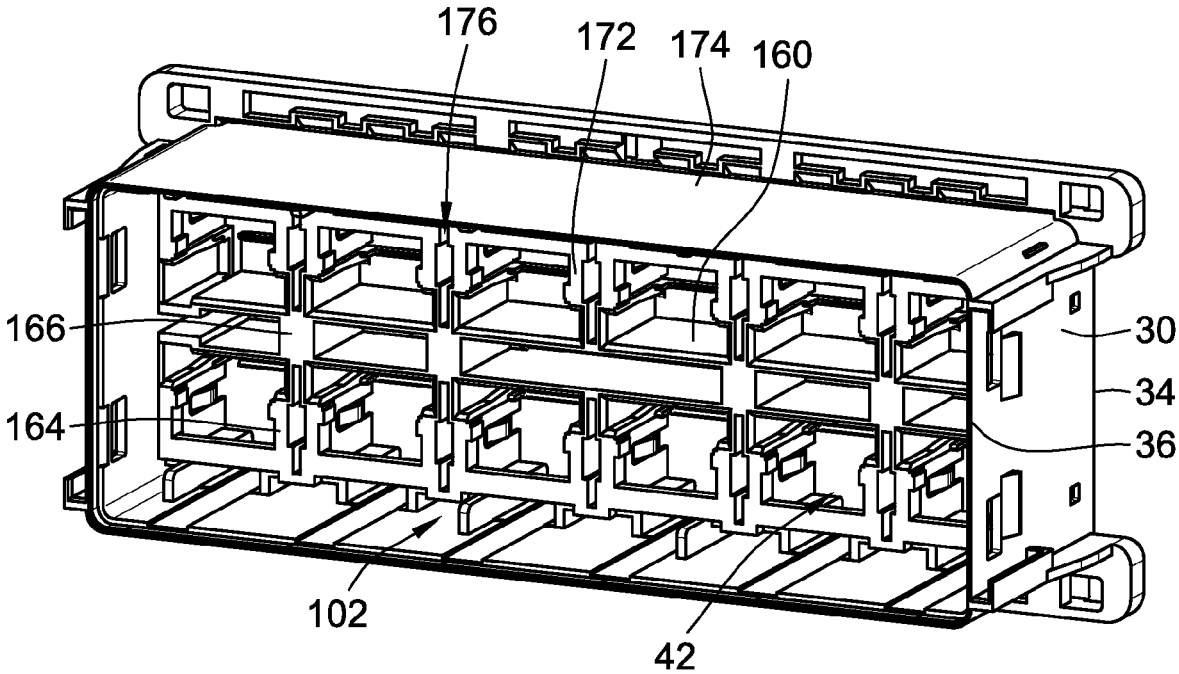
FIG. 8 is a rear perspective view of the housing shown in FIG. 7.

FIGS. 7 and 8 are front and rear perspective views, respectively, of the housing 30 of the cassette 20 (shown in FIG. 1). The housing 30 includes a plurality of interior walls 160 that extend between adjacent plug cavities 42. The walls 160 may extend at least partially between the front 34 and the rear 36 of the housing 30. The walls 160 have a front surface 162 (shown in FIG. 7) and a rear surface 164 (shown in FIG. 8). Optionally, the front surface 162 may be positioned at, or proximate to, the front 34 of the housing 30. The rear surface 164 may be positioned remote with respect to, and/or recessed from, the rear 36 of the housing 30. The housing 30 includes a tongue 166 represented by one of the walls 160 extending between the first and second rows 44, 46 of plug cavities 42. Optionally, the interior walls 160 may be formed integral with the housing 30.

In an exemplary embodiment, the housing 30 includes a rear chamber 102 (shown in FIG. 8) at the rear 36 of the housing 30. The rear chamber 102 is open to each of the plug cavities 42. Optionally, the rear chamber 102 extends from the rear 36 of the housing 30 to the rear surfaces 164 of the walls 160. The rear chamber 102 is open at the rear 36 of the housing 30. In the illustrated embodiment, the rear chamber 102 is generally box-shaped, however the rear chamber 102 may have any other shape depending on the particular application and/or the size and shape of the components filling the rear chamber 102.

In an exemplary embodiment, the plug cavities 42 are separated from adjacent plug cavities 42 by shield elements 172. The shield elements 172 may be defined by the interior walls 160 and/or exterior walls 174 of the housing 30. For example, the housing 30 may be fabricated from a metal material with the interior walls 160 and/of the exterior walls 174 also fabricated from the metal material. In an exemplary embodiment, the housing 30 is diecast using a metal or metal alloy, such as aluminum or an aluminum alloy. With the entire housing 30 being metal, the housing 30, including the portion of the housing 30 between the plug cavities 42 (e.g. The interior walls 160) and the portion of the housing 30 covering the plug cavities 42 (e.g. The exterior walls 174), operates to provide shielding around the plug cavities 42. In such an embodiment, the housing 30 itself defines the shield elements (s) 172. The plug cavities 42 may be completely enclosed (e.g. circumferentially surrounded) by the shield elements 172.

With each contact set 146 (shown in FIG. 6) arranged within a different plug cavity 42, the shield elements. 172 provide shielding between adjacent contact sets 146. The shield elements 172 thus provide isolation between the adjacent contact sets 146 to enhance the electrical performance of the contact sets 146 received in each plug cavity 42. Having shield elements 172 between adjacent plug cavities 42 provides better shield effectiveness for the cable interconnect system 10 (shown in FIG. 1), which may enhance electrical performance in systems that utilize components that do not provide shielding between adjacent plug cavities 42. For example, having shield elements 172 between adjacent plug, cavities 42 within a given row 44, 46 enhances electrical performance of the contact sets 146. Additionally, having shield elements 172 between the rows 44, 46 of plug cavities 42 may enhance the electrical performance of the contact sets 146. The shield elements 172 may reduce alien crosstalk between adjacent contact sets 146 in a particular cassette and/or reduce alien crosstalk with contact sets 146 of different cassettes 20 or other electrical components in the vicinity of the cassette 20. The shield elements may also enhance electrical performance of the cassette 20 in other ways, such as by providing EMI shielding or by affecting coupling attenuation, and the like.

In an alternative embodiment, rather than the housing 30 being fabricated from a metal material, the housing 30 may be fabricated, at least in part, from a dielectric material. Optionally, the housing 30 may be selectively metallized, with the metallized portions defining the shield elements 172. For example, at least a portion of the housing 30 between the plug cavities 42 may be metallized to define the shield elements 172 between the plug, cavities 42. Portions of the interior walls 160 and/or the exterior walls 174 may be metallized. The metallized surfaces: define the shield elements 172. As such, the shield elements 172 are provided on the interior walls 160 and/or the exterior walls 174. Alternatively, the shield elements 172 may be provided on the interior walls 160 and/or the exterior walls 174 in a different manner, such as by plating or by coupling separate shield elements 172 to the interior walls 160 and/or the exterior walls 174. The shield elements 172 may be arranged along the surfaces defining the plug cavities 42 such that at least some of the shield elements 172 engage the modular plugs 14 when the modular plugs 14 are loaded into the plug cavities 42. In other alternative embodiment, the walls 160 and/or 174 may be formed, at least in part, by metal filler materials provided within or on the walls 160 and/or 174 or metal fibers provided within or on the walls 160 and/or 174.

In another alternative embodiment, rather than, or in addition to, providing the shield elements 172 on the walls of the housing 30, the shield elements 172 may be provided within the walls of the housing 30. For example, the interior walls 160 and/or the exterior walls 174 may include openings 176 that are open at the rear 36 and/or the front 34 such that the shield elements 172 may be loaded into the openings 176. The shield elements 172 may be separate metal components, such as plates, that are loaded into the openings 176. The openings 176, and thus the shield elements 172, are positioned between the plug cavities 42 to provide shielding between adjacent contact sets 146.

Figure 9:
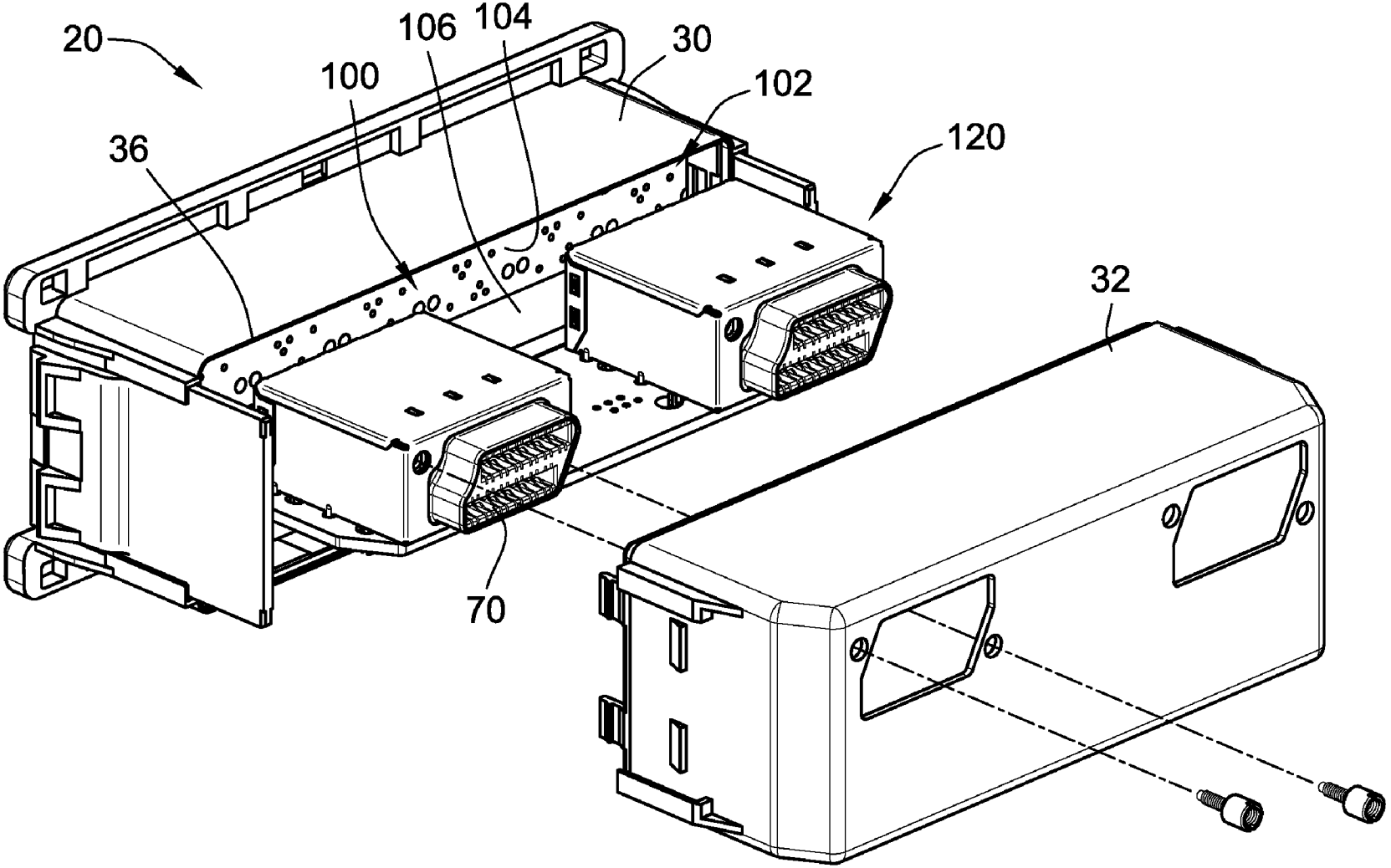
FIG. 9 is a rear perspective view of the cassette shown in FIG. 4 during assembly.

FIG. 9 is a rear perspective, partially assembled, view of the cassette 20. During assembly, the contact subassembly 100 is loaded into the rear chamber 102 of the housing 30 through the rear 36. Optionally, the circuit board 104 may substantially fill the rear chamber 102. The contact subassembly 100 is loaded into the rear chamber 102 such that the electrical connector 106 faces the rear 36 of the housing 30. The electrical connector 106 may be at least partially received in the rear chamber 102 and at least a portion of the electrical connector 106 may extend from the rear chamber 102 beyond the rear 36.

During assembly, the interface Connector assembly 120 is mated with the electrical connector 106. Optionally, the interface connector assembly 120 may be mated with the electrical connector 106 after the contact subassembly 100 is loaded into the housing 30. Alternatively, both the contact subassembly 100 and the interface connector assembly 120 may be loaded into the housing 30 as a unit. Optionally, some or all of the interface connector assembly 120 may be positioned rearward of the housing 30.

The cover 32 is coupled to the housing 30 after the contact subassembly 100 and the interface connector assembly 120 are positioned with respect to the housing 30. The cover 32 is coupled to the housing 30 such that the cover 32 surrounds the interface connector assembly 120 and/or the contact subassembly 100. In an exemplary embodiment, when the cover 32 and the housing 30 are coupled together, the cover 32 and the housing 30 cooperate to define an inner chamber 170 (shown in FIGS. 10 and 11). The rear chamber 102 of the housing 30 defines part of the inner chamber 170, with the hollow interior of the cover 32 defining another part of the inner chamber 170. The interface connector assembly 120 and the contact subassembly 100 are received in the inner chamber 170 arid protected from the external environment by the cover 32 and the housing 30. Optionally, the cover 32 and the housing 30 may provide shielding for the components housed within the inner chamber 170. The rear mating connectors 70 may extend through the cover 32 when the cover 32 is coupled to the housing 30. As such, the rear mating connectors 70 may extend at least partially out of the inner chamber 170.

Figure 10:
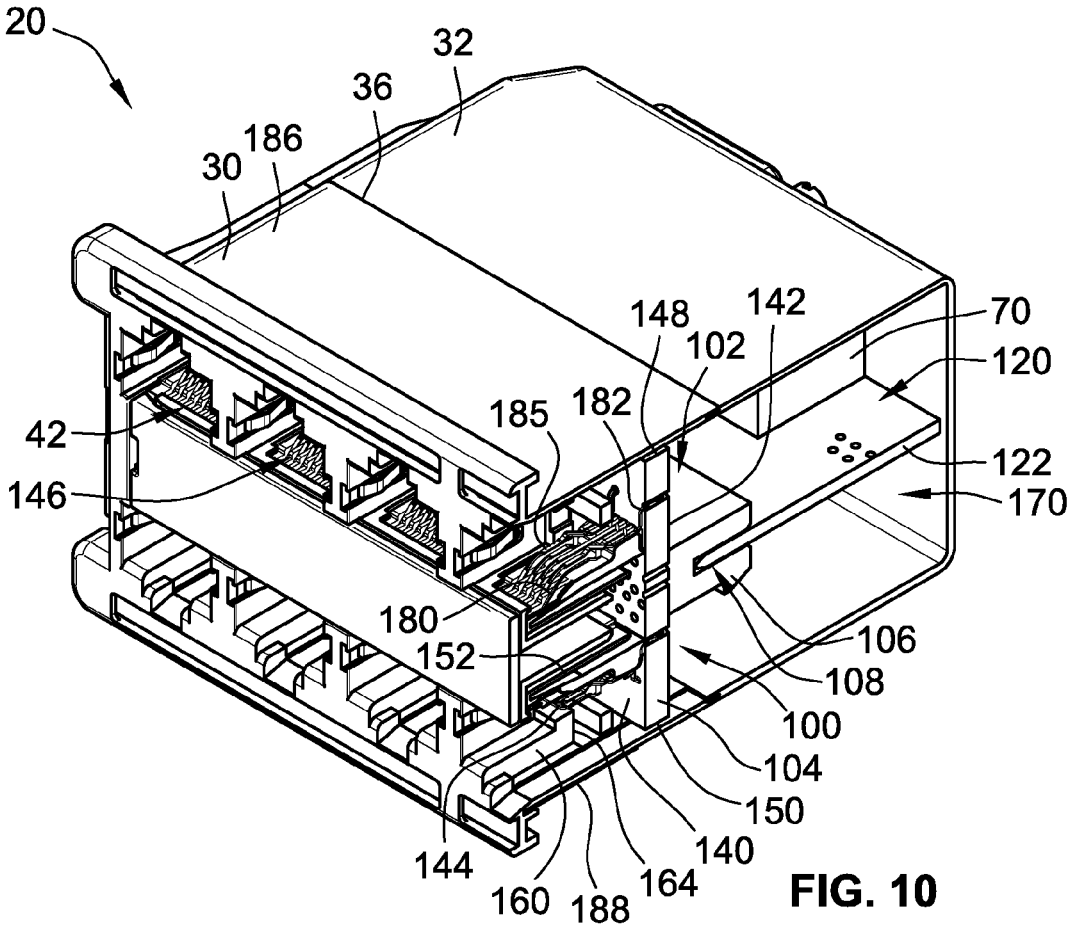
FIG. 10 is a side perspective, partial cutaway view of the cassette shown in FIG. 4.
Figure 11:
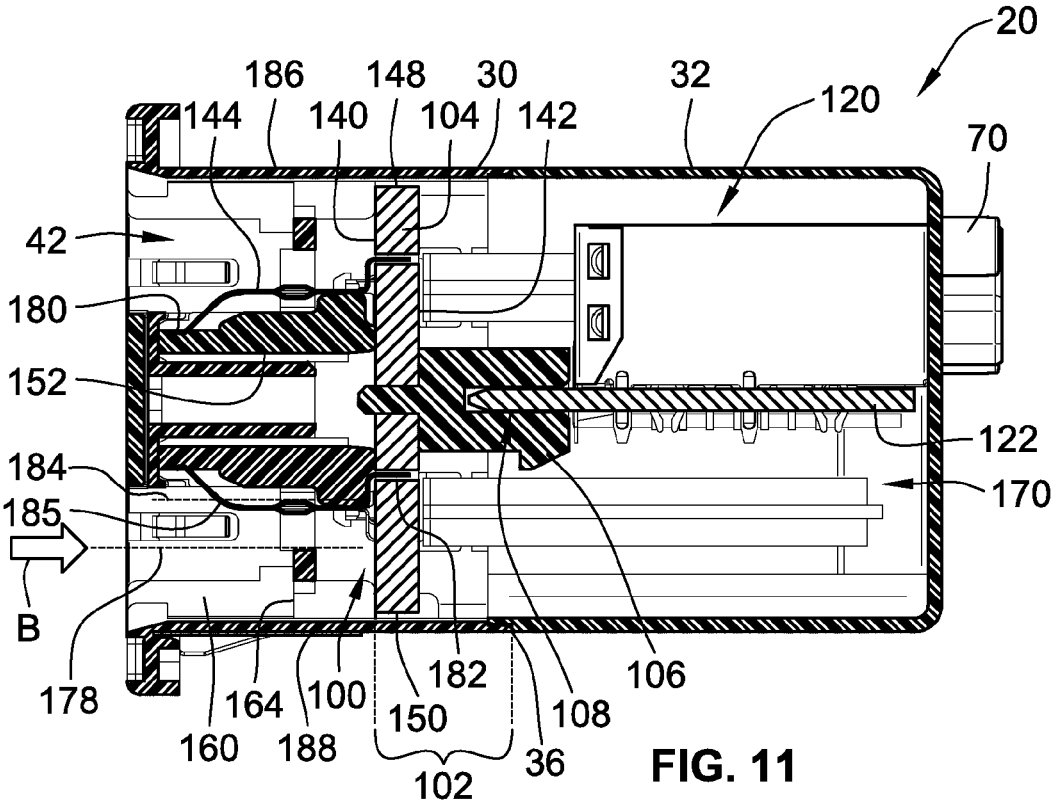
FIG. 11 is a cross-sectional view of the cassette shown in FIG. 4.

FIG. 10 is a side perspective, partial cutaway view of the cassette 20 and FIG. 11 is a cross-sectional view of the cassette 20. FIGS. 10 and 11 illustrate the contact subassembly 100 and the interlace connector assembly 120 positioned within the inner chamber 170, with the cover 32 coupled to the housing 30. The contact subassembly 100 is loaded into the rear chamber 102 such that the front side 140 of the circuit board 104 generally faces and/or abuts against the rear surfaces 164 of the walls 160. Optionally, the front side 140 may abut against a structure of the housing 30, such as the rear surfaces 164 of the walls 160, or alternatively, a rib or tab that extends from the housing 30 for locating the contact subassembly 100 within the housing 30. When the contact subassembly 100 is loaded into the rear chamber 102, the contacts 144 and the contact supports 152 are loaded into corresponding plug cavities 42.

When assembled, the plug cavities 42 and the contact sets 146 cooperate to define the receptacles 16 for mating with the modular plugs 14 (shown in FIG. 1). The walls 160 of the housing 30 define the walls of the receptacles 16 and the modular plugs 14 engage the walls 160 when the modular plugs 14 are loaded into the plug cavities 42. The contacts 144 are presented within the plug cavities 42 for mating with plug contacts of the modular plugs 14. In an exemplary embodiment, when the contact subassembly 100 is loaded into the housing 30, the contact supports 152 are exposed within the plug cavities 42 and define one side of the box-like cavities that define the plug cavities 42.

Each of the contacts 144 extend between a tip 180 and a base 182 generally along a contact plane 184 (shown in FIG. 11). A portion of the contact 144 between the tip 180 and the base 182 defines a mating interface 185. The contact plane 184 extends parallel to the modular plug loading direction, shown in FIG. 11 by the arrow B, which extends generally along a plug axis 178. Optionally, the tip 180 may be angled out of the contact plane 184 such that the tips 180 do not interfere with the modular plug 14 during loading of modular plug 14 into the plug cavity 42. The tips 180 may be angled towards and/or engage the contact supports 152. Optionally, the bases 182 may be angled out of the contact plane 184 such that the bases 182 may be terminated to the circuit board 104 at a predetermined location. The contacts 144, including the tips 180 and the bases 182, may be oriented with respect to one another to control electrical properties therebetween, such as crosstalk. In an exemplary embodiment, each of the tips 180 within the contact set 146 are generally aligned one another. The bases 182 of adjacent contacts 144 may extend either in the same direction or in a different direction as one another. For example, at least some of the bases 182 extend towards the top 148 of the circuit board 104, whereas some of the bases 182 extend towards the bottom of 150 of the circuit board 104.

In an exemplary embodiment, the circuit board 104 is generally perpendicular to the contact plane 184 and the plug axis 178. The top 148 of the circuit board 104 is positioned near a top side 186 of the housing 30, whereas the bottom 150 of the circuit board 104 is positioned near a bottom side 188 of the housing 30. The circuit board 104 is positioned generally behind the contacts 144, such as between the contacts 144 and the rear 36 of the housing 30. The circuit board 104 substantially covers the rear of each of the plug cavities 42 when the connector subassembly 100 is loaded into the rear chamber 102. In an exemplary embodiment, the circuit board 104 is positioned essentially equidistant from the mating interface 185 of each of the contacts 144. As such, the contact length between the mating interface 185 and the circuit board 104 is substantially similar for each of the contacts 144. Each of the contacts 144 may thus exhibit similar electrical Characteristics. Optionally, the contact length may be selected such that the distance between a mating interface 185 and the circuit board 104 is reasonably short. Additionally, the contact lengths of the contacts 144 in the upper row 44 (shown in FIG. 2) of plug cavities 42 are substantially similar to the contact lengths of the contacts 144 in the lower row 46 (shown in FIG. 2) of plug cavities 42.

The electrical connector 106 is provided on the rear side 142 of the circuit board 104. The electrical connector 106 is electrically connected to the contacts 144 of one or more of the contacts sets 146. The interface connector assembly 120 is mated with the electrical connector 106. For example, the circuit board 122 of the interface connector assembly 120 is loaded into the opening 108 of the electrical connector 106. The rear mating connectors 70, which are mounted to the circuit board 122, are electrically connected to predetermined contacts 144 of the contacts sets 146 via the circuit board 122, the electrical connector 106 and the circuit board 104. Other configurations are possible to interconnect the rear mating connectors 70 with the contacts 44 of the receptacles 16.

Figure 12:
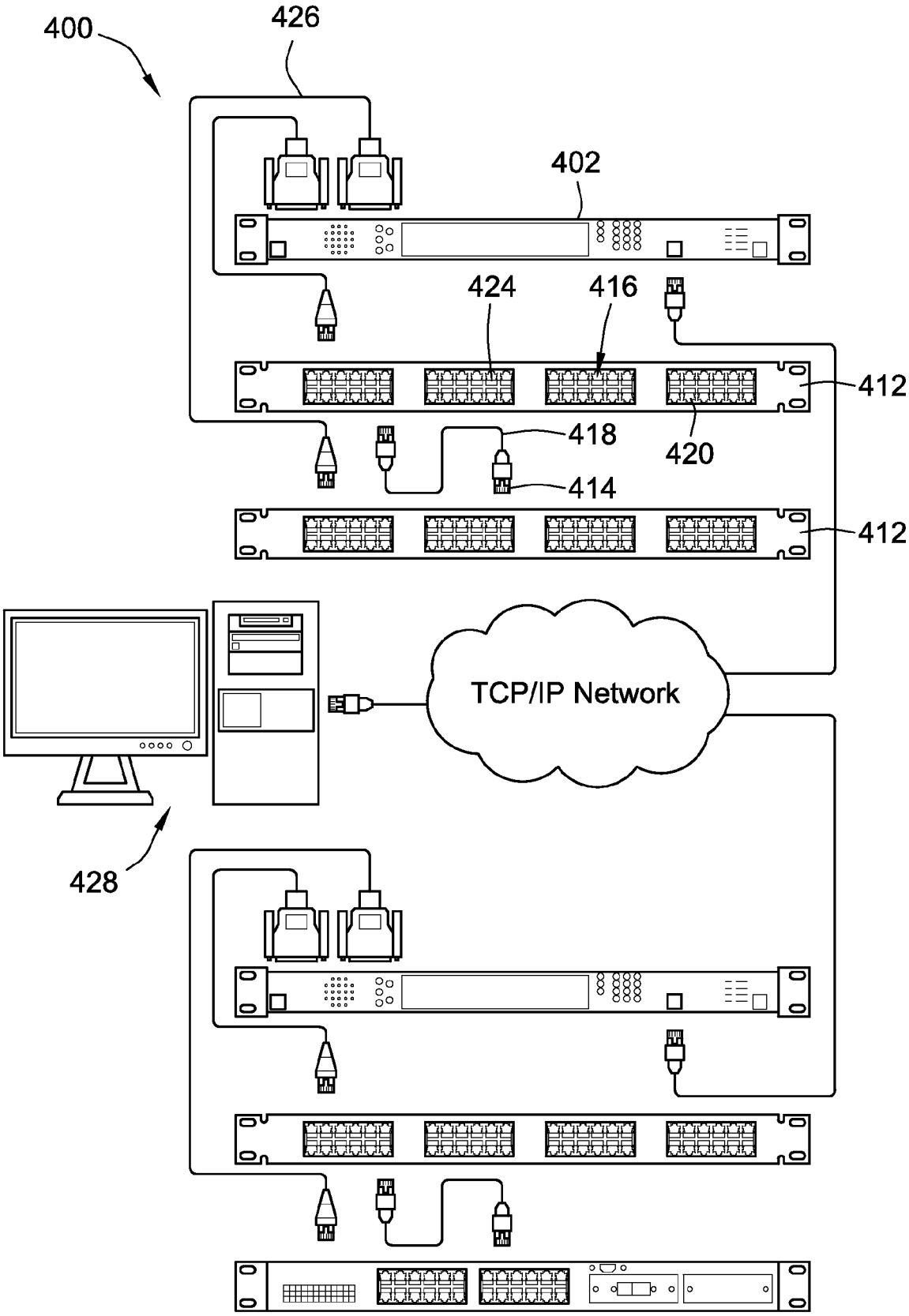
FIG. 12 illustrates a connectivity management system for use with the cable interconnect system shown in FIG. 1.

FIG. 12 illustrates a connectivity management system 400 for use with the cable interconnect system 10 shown in FIG. 1. The connectivity management system 400 includes an analyzer 402 for analyzing the connectivity of the components within the cable interconnect system 10. The cable interconnect system 10 includes panels 412 and a plurality of cassettes 420 mounted to the panels 412. The panels 412 and cassettes 420 may define patch panels, switches or other network components. Plugs 414 may be connected to any of the receptacles 416 of the cassettes 420. The plugs 414 are provided at ends of cables 418, such as patch cords. In an exemplary embodiment, the plugs 414 include network sensor probes 422 (shown in FIG. 14) used to indicate connectivity, as described in further detail below. The cables 418 may be routed between various ones of the panels 412 or other network components. The plugs 414 with the sensor probes 422 come from other equipment in the cable interconnect system 10.

The cassettes 420 include connectivity sensors 424 at the mating interface thereof for interfacing with the sensor probes 422 when the plugs 414 are received in the receptacles 416. The connectivity sensors 424 are used to indicate connectivity, such as by sensing the sensor probes 422 and sending signals relating to the presence of the sensor probes 422 to the analyzer 402, such as via connectivity cables 426 that interconnect the cassettes 420 and the analyzer 402.

Connectivity cables 426 are cables that form part of the connectivity management, system 400 and generally interconnect the cassettes 420 with the analyzer 402. Connectivity cables 426 extend from the rear of the cassettes 420 as opposed to the communication cables 418 which extend from the front of the cassettes 420. The cables 418 are part of the cable interconnect system 10 and are used to transmit data between components of the cable interconnect system 10, as opposed to the connectivity management system 400.

The analyzer 402 determines the connectivity of the cables within the cable interconnect system 10 (e.g. which plug 414 is connected to which receptacle 416 and/or where each patch cord or cable 418 is routed within the cable interconnect system 10). In an exemplary embodiment, the analyzer 402 is an analyzing device, such as the AMPTRAC Analyzer commercially available from Tyco Electronics Corporation. Optionally, the analyzer 402 may be mounted to a rack or other support structure of the cable interconnect system 10. Alternatively, the analyzer 402 may be positioned remote from the rack and the network panels 412. Data relating to the connectivity or interconnection of the patch cords of cables 418 is transmitted to the analyzer 402 by the connectivity cables 426.

In an exemplary embodiment, the analyzer 402 is interconnected with a computing device 428 by an Ethernet connection or another connection, such as a direct connection by a cable connector. The connectivity data is gathered by connectivity sensors 424 that sense when the plugs 414 are mated with the receptacles 416. The connectivity data gathered by the analyzer 402 may be transmitted to the computing device 428 and then viewed, stored and/or manipulated by the computing device 428. Alternatively, the analyzer 402 may store and/or manipulate the connectivity data. Optionally, the analyzer 402 and the computing device 428 may be one device. Optionally, multiple analyzers 402 maybe connected to the computing device 428.

Figure 13:
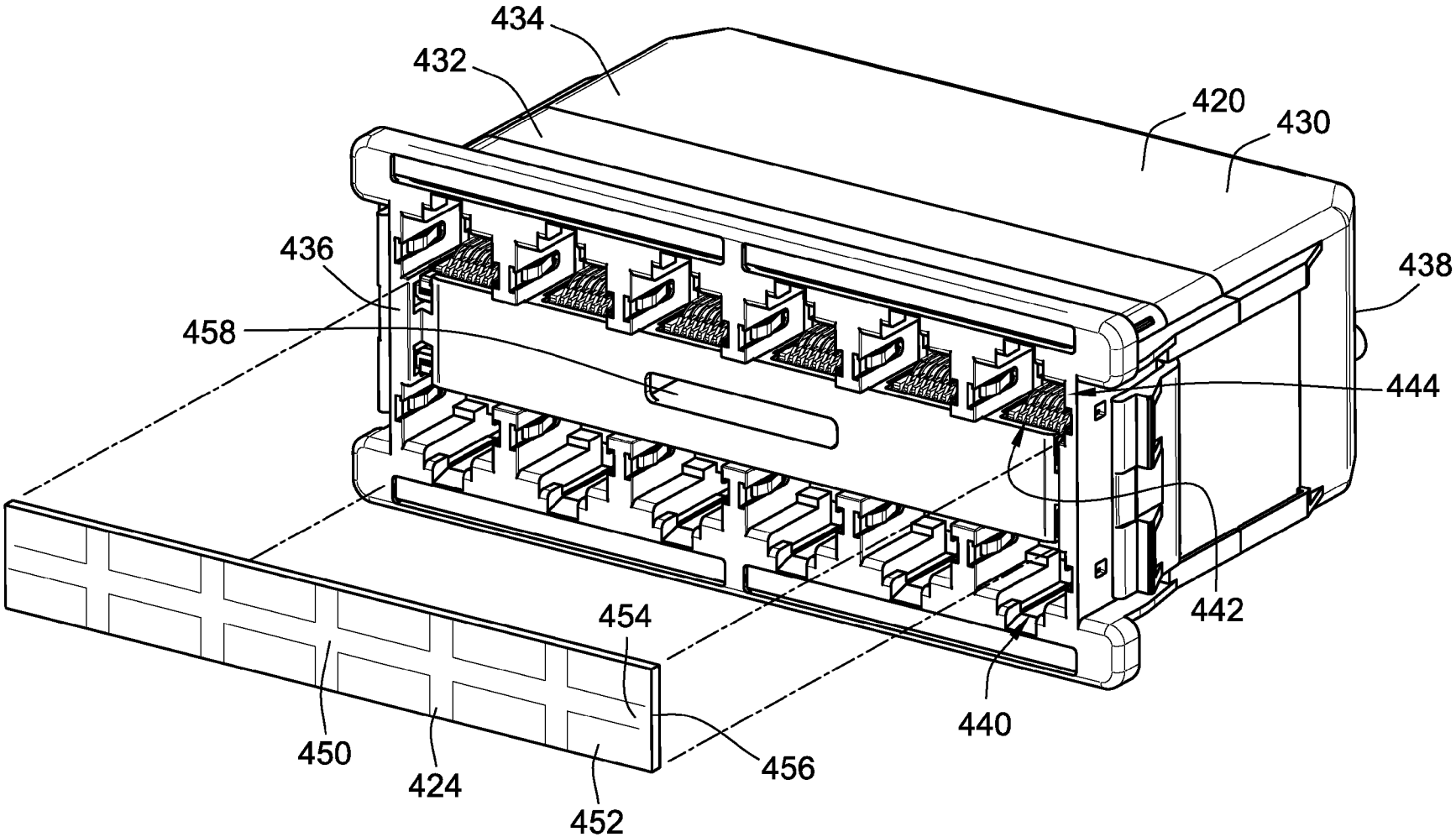
FIG. 13 is an exploded view of a cassette for use with the connectivity management system shown in FIG. 12, illustrating a connectivity sensor for the cassette.

FIG. 13 is an exploded view of the cassette 420 for use with the connectivity management system 400 (shown in FIG. 12), illustrating the connectivity sensor 424 for the cassette 420. The cassette 420 is similar to the cassette 20 (shown in FIG. 1), however the cassette 420 includes the connectivity sensor 424 and other components that form part of the connectivity management system 400. The cassette 420 includes a shell 430 having a housing 432 and a cover 434. The shell 430 includes a front 436 and a rear 438. The cassette 420 includes a plurality of plug cavities 440 and a contact subassembly 442 positioned within the shell 430. The contact subassembly 442 provides contacts 444 within the plug cavities 440.

The connectivity sensor 424 is coupled to the housing 432 of the shell 430. In an exemplary embodiment, the connectivity sensor 424 is coupled to the front 436 generally between rows of the plug cavities 440. The connectivity sensor 424 includes, a circuit board 450 having a plurality of sensor pads 452 arranged on a front side 454 of the circuit board 450. The connectivity sensor 424 is mounted to the housing 432 such that a rear side 456 of the circuit board 450 generally faces and/or engages the front 436 of the shell 430. The connectivity sensor 424 is mounted to the housing 432 such that the sensor pads 452 are aligned with corresponding plug cavities 440. For example, some of the sensor pads 452 may be arranged below one row the plug cavities 440, and some of the sensor pads 452 may be arranged above another row of the plug cavities 440. Optionally, an equal number of sensor pads 452 and plug cavities 440 are provided. In an exemplary embodiment, the housing 432 includes an opening 458 at the front 436. Optionally, a portion of the connectivity sensor 424 may extend through the opening into the internal cavity defined by the shell 430.

Figure 14:
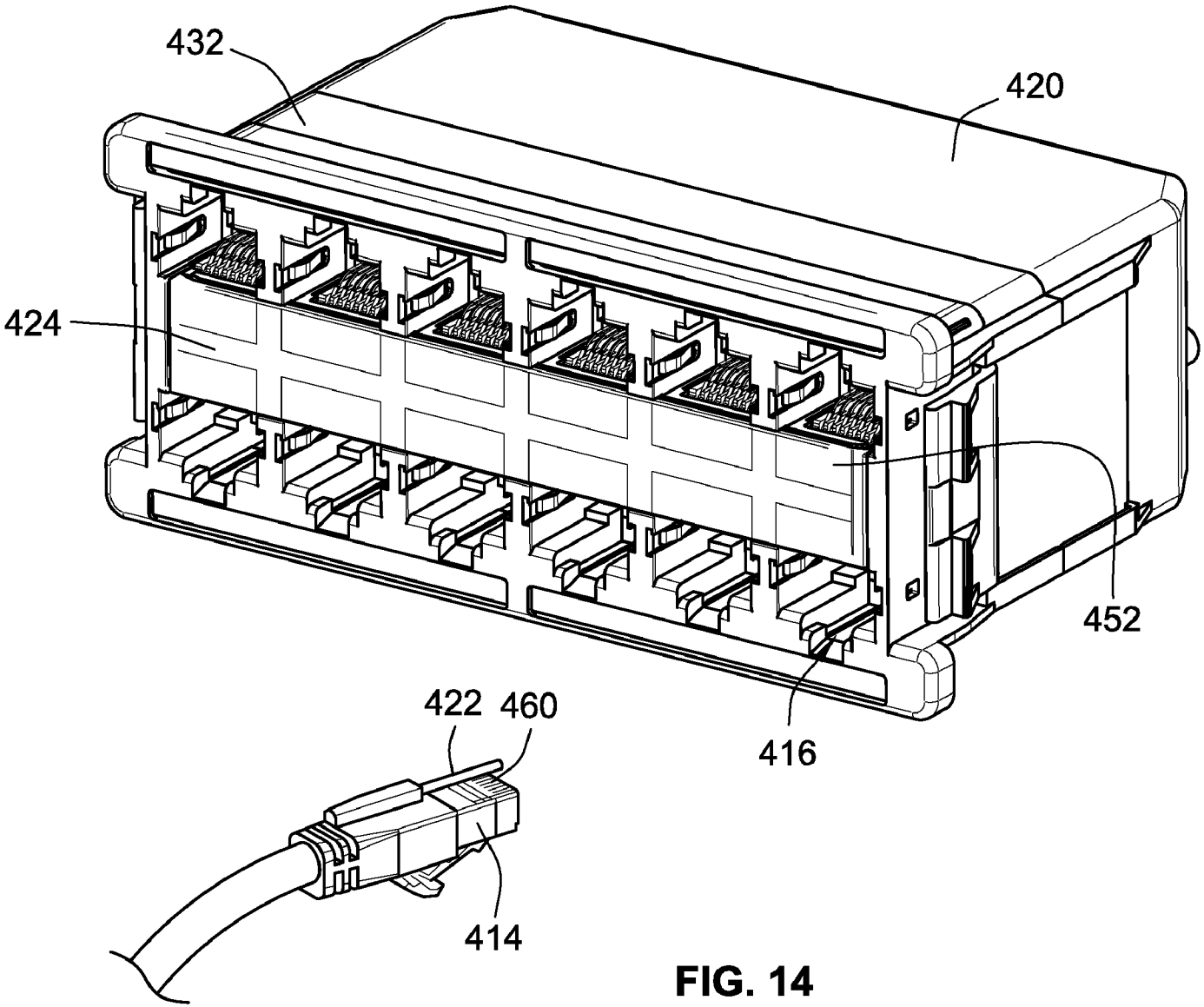
FIG. 14 illustrates a modular plug being mated with the cassette shown in FIG. 13.

FIG. 14 illustrates one of the plugs 414 being mated with the cassette 420. FIG. 14 also illustrates the connectivity sensor 424 coupled to the housing 432. The sensor pads 452 are aligned with corresponding ones of the plug cavities 440. In an exemplary embodiment, the plug 414 is configured for use with the connectivity management system 400. The modular plug 414 includes the sensor probe 422 that interfaces with the sensor pad 452 when the modular plug 414 is loaded into the receptacle 416. Optionally, the sensor probe 422 may be a Pogo-pin type of probe, however other types of probes may be used in alternative embodiments. The sensor probe 422 represents an additional contact that is connected to an additional wire (referred to as a $9^{th}$ wire in some particular applications) in addition to the plug contacts 460 that mate with the contacts 444 of the contact subassembly 442. The sensor probe 422 transmits data relating to connectivity of the modular plug 414. When the sensor probe 422 engages the sensor pad 452, the data transmitted by the sensor probe 422 may be sensed by the sensor pad 452.

Figure 15:
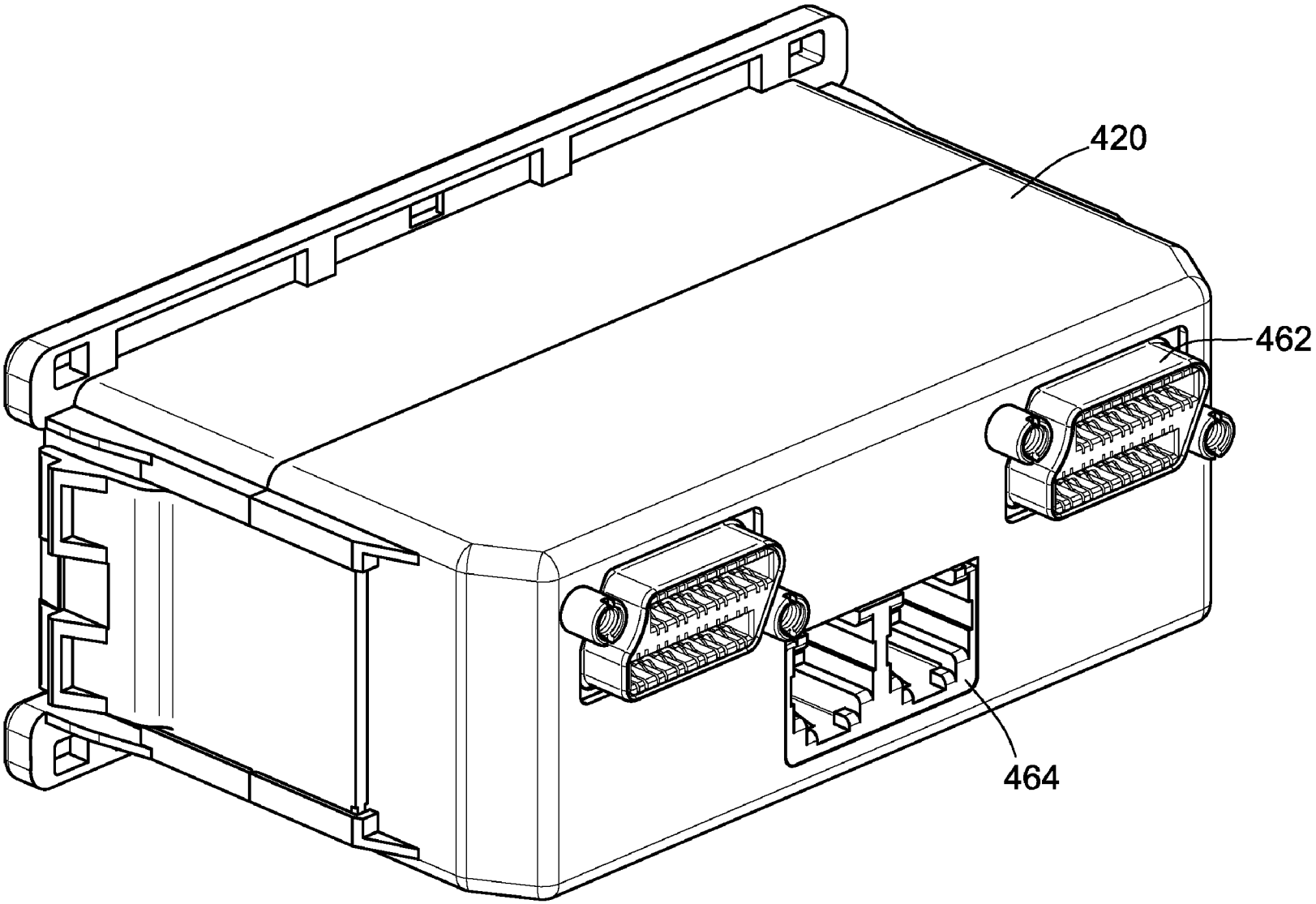
FIG. 15 is a rear perspective view of the cassette shown in FIG. 13.

FIG. 15 is a rear perspective view of the cassette 420. The cassette 420 includes one or more rear mating connectors 462 and one or more rear connectivity connectors 464. The rear mating connectors 462 are configured for mating with back end cable; connectors. The rear connectivity connectors 464 are configured to made with the connectivity cables 426 (shown in FIG. 12) that are connected to the analyzer 402 (shown in FIG. 12). The rear connectivity connectors 464 form part of the connectivity management system 400 and are used to transmit data relating to the connectivity of the receptacles 416 (shown in FIG. 12). In the illustrated embodiment, the rear mating connectors 462 are represented by RJ-21 connectors, however other types of connectors may be used in alternative embodiments. In the illustrated embodiment, the rear connectivity connectors 464 are represented by RJ-11 connectors, however other types of connectors may be used in alternative embodiments.

Figure 16:
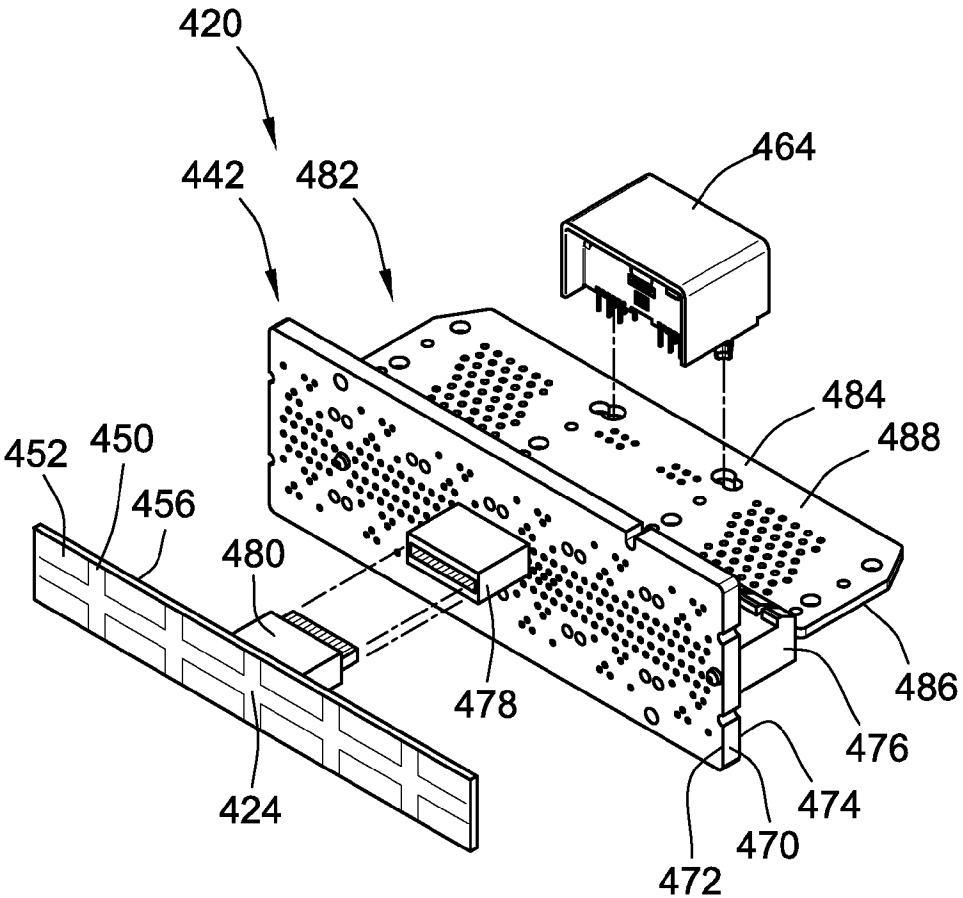
FIG. 16 is an exploded view of a portion of the cassette shown in FIG. 13.

FIG. 16 is an exploded view of a portion of the cassette 420 with the shell 430 (shown in FIG. 13) and a portion of contact subassembly 442 removed for clarity. The contact subassembly 442 includes a circuit board 470 having a front side 472 and a rear side 474. An electrical connector 476 is board mounted to the rear side 474 of the circuit board 470. The electrical connector 476 may be similar to the electrical connector 106 (shown in FIG. 5). In the illustrated embodiment, the electrical connector 476 represents a card edge connector, however other types of connectors may be utilized in alternative embodiments. In an exemplary embodiment, the contact subassembly 442 includes the contacts 444 (shown in FIG. 13) and a plurality of contact supports, both of which are not shown for clarity. The contact supports may be similar to the contact supports 152 (shown in FIG. 5).

The contact subassembly 442 includes a connectivity connector 478 extending from the front side 472 of the circuit board 470. The connectivity connector 478 is electrically connected to the circuit board 470. The connectivity connector 478 may be electrically connected to the electrical connector 476 via the circuit board 470. Alternatively, the connectivity, connector 478 may be directly connected to the electrical connector 476. The connectivity connector 478 may be board mounted to the circuit board 470. For example, the connectivity connector 478 may include contacts, such as socket contacts, that are terminated to the circuit board 470, such as by through-hole mounting or surface mounting to the circuit board 470. Optionally, more than one connectivity connector 478 may be provided.

The connectivity sensor 424 includes a connectivity connector 480 extending from the rear 456 of the circuit board 450. The connectivity connector 480 of the connectivity sensor 424 is configured to mate with the connectivity connector 478 of the contact subassembly 442. For example, one of the connectivity connectors 478 or 480 may be a plug-type of connector while the other connectivity connector 478 or 480 may be a receptacle-type of connector. The connectivity connector 480 is electrically connected to the circuit board 450. The connectivity connector 480 may be board mounted to circuit board 450. For example, the connectivity connector 480 may include contacts, such as pin contacts, that are terminated to the circuit board 450, such as by through-hole mounting or surface mounting to the circuit board 450. The connectivity connector 480 is electrically connected to one or more of the sensor pads 452 via the circuit board 450. In an exemplary embodiment, the connectivity connector 480 is electrically connected to each of the sensor pads 452 arranged on the circuit board 450. Alternatively, the connectivity connector 480 may be electrically connected to less than all of the sensor pads 452. In such an embodiment, more than one connectivity connector 480 may be provided. The sensor pads 452 are electrically connected to the contact subassembly 442 via the connectivity connectors 478, 480.

In an alternative embodiment, only one connectivity connector may be provided between the circuit board 450 of the connectivity sensor 424 and the circuit board 470 of the contact subassembly 442. For example, the connectivity connector may be board mounted to one of the circuit boards 450 or 470 and may be mated with the other circuit board 450 or 470 during assembly. In another alternative embodiment, no connectivity connectors are provided between the connectivity sensor 424 in the contact subassembly 442. Other connection means or components may be provided to electrically connect the sensor pads 452 with the rear connectivity connector 464, such as a wire harness, a wireless connection, a fiber-optic connector, or another type of connector.

In an exemplary embodiment, the cassette 420 includes an interface connector 482. The interface connector 482 may be similar to the interface connector assembly 120 (shown in FIG. 5), with the addition of the rear connectivity connector 464. The interface connector 482 is electrically connected to the electrical connector 476 of the contact subassembly 442.

The interface connector 482 includes a circuit board 484 having a first side 486 and a second side 488. The rear mating connectors 462 (shown in FIG. 15) may be mounted to the first side 486 and the rear connectivity connector 464 may be mounted to the second side 488. Optionally, the rear connectivity connector 464 may be board mounted to the circuit board 484. In an exemplary embodiment, the circuit board 484 includes a plurality of edge contacts (not shown) at an edge thereof. The circuit board 484 is mated with the electrical connector 476 by plugging the edge of the circuit board 484 into the electoral connector 476. Alternatively, a separate electrical connector may be board mounted to the circuit board 484 and mated with the electrical connector 476 of the contact subassembly 442.

Figure 17:
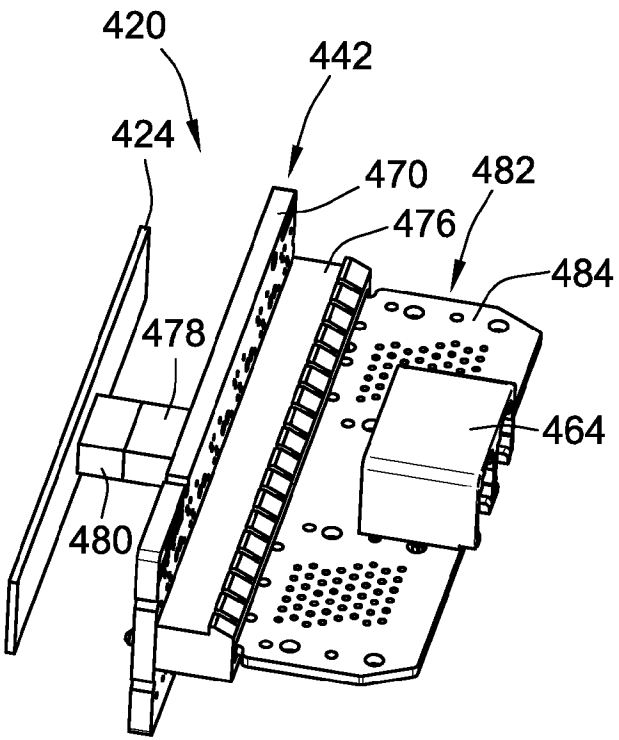
FIG. 17 is an assembled view of the portion of the cassette shown in FIG. 16.

FIG. 17 is an assembled view of the portion of the cassette 420 (shown in FIG. 16). FIG. 17 illustrates the interface connector 482 coupled to the contact subassembly 442 and the connectivity sensor 424 coupled to the contact subassembly 442. The interface connector 482 is electrically connected to the connectivity sensor 424 via the contact subassembly 442.

An electrical circuit is created between the connectivity sensor 424 and the fear connectivity connector 464 by the connectivity connectors 478, 480, the circuit board 470, the electrical connector 476, and the circuit board 484. The electrical circuit thus includes board mounted electrical connectors and circuit boards. The electrical circuit is completed without the use of wire harnesses. Electrical connections made by board mounted electrical connectors are easier to manufacture and may be more reliable than wire, harnesses. It is realized that the electrical circuit between the connectivity sensor 424 and the rear connectivity connector 464 may be made without some of the components utilized in the illustrated embodiment. Alternatively, more or different components may be utilized as part of the electrical circuit.

It is to be understood that the above description is intended to be illustrative, and not restrictive. For example, the above-described embodiments (and/or aspects thereof) may be used in combination with each other. In addition, many modifications may be made to adapt a particular situation of material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following; claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A cassette comprising:

a housing having a plurality of plug cavities configure to receive plugs therein;

a contact subassembly received in the housing, the contact subassembly having a circuit board and a plurality of contacts coupled to the circuit board, the contacts being arranged in contact sets that are received in corresponding plug cavities to mate with different corresponding plugs; and a connectivity sensor coupled to the housing, the connectivity sensor having a plurality of sensor pads configured to interface with sensor probes of the plugs when the plugs are loaded into the plug cavities, the connectivity sensor having a connectivity connector electrically coupled to at least some of the sensor pads, the connectivity connector being electrically connected to the circuit board of the contact subassembly.

2. The cassette of claim 1, wherein the housing has a front, the plug cavities being open through the front and the plugs being loaded into the plug cavities in a direction perpendicular to the front, the circuit board of the contact subassembly being arranged parallel to the front of the housing.

3. The cassette of claim 1, wherein the connectivity sensor has a circuit board, the sensor pads being arranged on a front side of the circuit board, the connectivity sensor having a connectivity connector coupled to a rear side of the circuit board and being electrically connected to at least some of the sensor pads, the connectivity connector being electrically coupled to the circuit board of the contact subassembly.

4. The cassette of claim 1, wherein the contact subassembly includes a connectivity connector, the connectivity sensor being electrically connected to the connectivity connector of the contact subassembly.

5. The cassette of claim 1, wherein the circuit board of the connectivity sensor is arranged generally parallel to the circuit board of the contact subassembly, the connectivity sensor includes a board mounted connectivity connector and the contact subassembly includes a board mounted connectivity connector, the connectivity connectors being mated to one another to allow communication therebetween.

6. The cassette of claim 1, wherein the connectivity sensor is coupled to the housing such that the sensor pads are aligned with corresponding plug cavities.

7. The cassette of claim 1, wherein the connectivity sensor is configured to communicate with an analyzer of the connectivity management system via the circuit board of the contact subassembly.

8. The cassette of claim 1, further comprising a rear connectivity connector received within the housing, the rear connectivity connector being electrically connected to the circuit board of the contact subassembly, the rear connectivity connector being configured to mate with a connectivity cable at a rear of the housing.

9. The cassette of claim 1, further comprising a rear connectivity connector received within the housing, the circuit board of the contact subassembly being electrically connected between the rear connectivity connector and the connectivity sensor.

10. A cassette comprising:

a shell defining a plurality of plug cavities for receiving plugs therein;

a contact subassembly received within the shell, the contact subassembly having a circuit board, a plurality of contacts extending from a first side of the circuit board and an electrical connector extending from an opposite side of the circuit board, the contacts being configured to mate with corresponding plugs, the electrical connector being electrically connected to corresponding contacts;

a connectivity sensor coupled to the shell, the connectivity sensor being electrically connected to the circuit board of the contact subassembly, the connectivity sensor having a plurality of sensor pads configured to interface with sensor probes of the plugs when the plugs are loaded into the plug cavities; and an interface connector received within the shell, the interface connector being mated with the electrical connector, the interface connector having a rear connectivity connector accessible at the rear of the shell that is configured to mate with a connectivity cable, the rear connectivity connector being electrically connected to the connectivity sensor via the electrical connector.

11. The cassette of claim 10, wherein the connectivity sensor is positioned on the first side of the circuit board of the contact subassembly generally opposite to the interface connector.

12. The cassette of claim 10, wherein the interface connector includes a circuit board, the rear connectivity connector being board mounted to the circuit board.

13. The cassette of claim 10, wherein the electrical connector defines a card edge connector having an opening, the interface connector includes a circuit board having a plurality of edge contacts, the interface connector being mated with the electrical connector such that the edge contacts are received in the opening.

14. The cassette of claim 10, wherein the connectivity sensor has a connectivity connector electrically coupled to at least some of the sensor pads, the connectivity connector being either directly coupled to the circuit board of the contact subassembly or directly coupled to a corresponding connectivity connector that is board mounted to the circuit board of the contact subassembly.

15. The cassette of claim 10, wherein the contact subassembly includes a connectivity connector extending from the first side of the circuit board of the contact subassembly, the connectivity sensor being electrically connected to the connectivity connector of the contact subassembly.

16. A cassette comprising:

a connectivity sensor having a circuit board and a plurality of sensor pads electrically connected to the circuit board, the sensor pads being configured to interface with sensor probes of plugs mated with the cassette;

an interface connector having a circuit board and a rear connectivity connector mounted to the circuit board, the rear connectivity connector being arranged generally opposite to the connectivity sensor, the rear connectivity connector being configured to mate with a connectivity cable; and a contact subassembly arranged between the connectivity sensor and the interface connector, the contact subassembly having a circuit board, the connectivity sensor being coupled to a first side of the circuit board and the interface connector being coupled to a second side of the circuit board that is opposite to the first side, the rear connectivity connector being electrically connected to the connectivity sensor via the circuit board of the contact subassembly.

17. The cassette of claim 16, wherein the contact subassembly includes a connectivity connector extending from the first side of the circuit board of the contact subassembly, and the contact subassembly includes an electrical connector extending from the second side of the circuit board of the contact subassembly, wherein at least one of the connectivity connector and the electrical connector define a card edge connector.

18. The cassette of claim 16, wherein the rear connectivity connector and the connectivity sensor are interconnected via board mounted electrical connectors and the circuit boards.

19. The cassette of claim 16, wherein the connectivity sensor has a connectivity connector electrically coupled to at least some of the sensor pads, the connectivity connector being electrically coupled to the circuit board of the contact subassembly.

20. The cassette of claim 16, wherein the circuit board of the connectivity sensor is arranged generally parallel to the circuit board of the contact subassembly, the connectivity sensor includes a board mounted connectivity connector and the contact subassembly includes a board mounted connectivity connector, the connectivity connectors being mated to one another to allow communication therebetween.

* * * * *